US009206614B2

(12) United States Patent
Richardson et al.

(10) Patent No.: US 9,206,614 B2
(45) Date of Patent: Dec. 8, 2015

(54) STAY-IN-PLACE FORMWORK WITH ENGAGING AND ABUTTING CONNECTIONS

(71) Applicant: CFS Concrete Forming Systems Inc., Vancouver (CA)

(72) Inventors: George David Richardson, Vancouver (CA); Semion Krivulin, Richmond (CA); Zi Li Fang, New Westminster (CA)

(73) Assignee: CFS Concrete Forming Systems Inc., Vancouver (CA)

( * ) Notice: Subject to any disclaimer, the term of this patent is extended or adjusted under 35 U.S.C. 154(b) by 0 days.

(21) Appl. No.: 14/360,600

(22) PCT Filed: Nov. 23, 2012

(86) PCT No.: PCT/CA2012/050850

§ 371 (c)(1),
(2) Date: May 23, 2014

(87) PCT Pub. No.: WO2013/075251

PCT Pub. Date: May 30, 2013

(65) Prior Publication Data

US 2014/0318062 A1 Oct. 30, 2014

Related U.S. Application Data

(60) Provisional application No. 61/563,595, filed on Nov. 24, 2011.

(51) Int. Cl.
*E04C 1/00* (2006.01)
*E04G 11/06* (2006.01)
(Continued)

(52) U.S. Cl.
CPC ..... *E04G 11/06* (2013.01); *E04B 2/8635* (2013.01); *E04B 2/8641* (2013.01); *E04B 2/8652* (2013.01); *E04C 2/20* (2013.01); *E04B 1/12* (2013.01)

(58) Field of Classification Search
CPC ..... E04G 17/00; E04G 11/06; E04B 1/66; E04B 1/12; E04B 2/86; E04B 2/8641; E04B 2/8652; E04B 2/8635; E04B 2002/867; E04B 2002/8676; E04C 2/20
USPC ..... 52/426, 421, 309.1, 309.4, 309.12, 52/309.17, 425, 439; 249/191, 194, 195, 249/213, 216
See application file for complete search history.

(56) References Cited

U.S. PATENT DOCUMENTS 154,179 A 8/1874 Hubert
374,826 A 12/1887 Clarke
(Continued)

FOREIGN PATENT DOCUMENTS

CA 0574720 4/1959
CA 0957816 11/1974
(Continued)

OTHER PUBLICATIONS

Vector Corrosion Technologies Marketing Materials, 2005.
(Continued)

*Primary Examiner* — Mark Wendell
(74) *Attorney, Agent, or Firm* — Todd A. Rattray; Oyen Wiggs Green & Mutala LLP

(57) ABSTRACT

An apparatus for a formwork assembly comprises a plurality of elongated panels connectable to one another in edge-adjacent relationship. The plurality of panels comprise first and second edge-adjacent panels connectable to one another at a connection between a male connector component of the first panel and a female connector component of the second panel. The female connector component comprises a female engagement portion which defines a principal receptacle and the male connector component comprises a male engagement portion which is received in the principal receptacle to form the connection. The female connector component comprises a first abutment portion and the male connector component comprising a second abutment portion which abuts against the first abutment portion to form the connection. The first and second abutment portions are located outside of the principal receptacle.

26 Claims, 18 Drawing Sheets

(51) Int. Cl.

| | |
|---|---|
| ***E04B 2/86*** | (2006.01) |
| ***E04C 2/20*** | (2006.01) |
| *E04B 1/12* | (2006.01) |

(56) References Cited

U.S. PATENT DOCUMENTS

| | | | |
|---|---|---|---|
| 510,720 | A | 12/1893 | Stewart, Jr. |
| 820,246 | A | 5/1906 | Nidds |
| 3,545,152 | A | 12/1907 | Knohl |
| 1,035,206 | A | 8/1912 | Lewen |
| 1,080,221 | A | 12/1913 | Jester |
| 1,244,608 | A | 10/1917 | Hicks |
| 1,276,147 | A | 8/1918 | White |
| 1,345,156 | A | 6/1920 | Flynn |
| 1,423,879 | A | 7/1922 | Potter |
| 1,637,410 | A | 8/1927 | Corybell |
| 1,653,197 | A | 12/1927 | Barnes |
| 1,715,466 | A | 6/1929 | Miller |
| 1,820,897 | A | 8/1931 | White et al. |
| 1,875,242 | A | 8/1932 | Hathaway |
| 1,915,611 | A | 6/1933 | Miller |
| 1,963,153 | A | 6/1934 | Schmieder |
| 2,008,162 | A | 7/1935 | Waddell |
| 2,050,258 | A | 8/1936 | Bemis |
| 2,059,483 | A | 11/1936 | Parsons |
| 2,076,472 | A | 4/1937 | London |
| 2,164,681 | A | 7/1939 | Fould |
| 2,172,052 | A | 9/1939 | Robbins |
| 2,326,361 | A | 8/1943 | Jacobsen |
| 2,861,277 | A | 11/1958 | Hermann |
| 2,871,619 | A | 2/1959 | Walters |
| 2,892,340 | A | 6/1959 | Fort |
| 2,928,115 | A | 3/1960 | Hill |
| 3,063,122 | A | 11/1962 | Katz |
| 3,100,677 | A | 8/1963 | Frank et al. |
| 3,152,354 | A | 10/1964 | Diack |
| 3,184,013 | A | 5/1965 | Pavlecka |
| 3,196,990 | A | 7/1965 | Handley |
| 3,199,258 | A | 8/1965 | Jentoft et al. |
| 3,220,151 | A | 11/1965 | Goldman |
| 3,288,427 | A | 11/1966 | Pluckebaum |
| 3,291,437 | A | 12/1966 | Bowden et al. |
| 3,468,088 | A | 9/1969 | Miller |
| 3,555,751 | A | 1/1971 | Thorgusen |
| 3,588,027 | A | 6/1971 | Bowden |
| 3,769,769 | A | 11/1973 | Kohl |
| 3,788,020 | A | 1/1974 | Gregori |
| 3,886,705 | A | 6/1975 | Cornland |
| 3,951,294 | A | 4/1976 | Wilson |
| 3,991,636 | A | 11/1976 | Devillers |
| 4,023,374 | A | 5/1977 | Colbert et al. |
| 4,060,945 | A | 12/1977 | Wilson |
| 4,104,837 | A | 8/1978 | Naito |
| 4,106,233 | A | 8/1978 | Horowitz |
| 4,180,956 | A | 1/1980 | Gross |
| 4,193,243 | A | 3/1980 | Tiner |
| 4,276,730 | A | 7/1981 | Lewis |
| 4,351,870 | A | 9/1982 | English |
| 4,383,674 | A | 5/1983 | Fricker |
| 4,430,831 | A | 2/1984 | Kemp |
| 4,433,522 | A | 2/1984 | Yerushalmi |
| 4,434,597 | A | 3/1984 | Fischer |
| 4,508,310 | A | 4/1985 | Schultz |
| 4,532,745 | A | 8/1985 | Kinard |
| 4,543,764 | A | 10/1985 | Kozikowski |
| 4,550,539 | A | 11/1985 | Foster |
| 4,553,875 | A | 11/1985 | Casey |
| 4,575,985 | A | 3/1986 | Eckenrodt |
| 4,581,864 | A | 4/1986 | Shvakhman et al. |
| 4,606,167 | A | 8/1986 | Thorne |
| 4,695,033 | A | 9/1987 | Imaeda et al. |
| 4,703,602 | A | 11/1987 | Pardo |
| 4,731,964 | A | 3/1988 | Phillips |
| 4,731,971 | A | 3/1988 | Terkl |
| 4,742,665 | A | 5/1988 | Baierl |
| 4,856,754 | A | 8/1989 | Yokota et al. |
| 4,866,891 | A | 9/1989 | Young |
| 4,946,056 | A | 8/1990 | Stannard |
| 4,995,191 | A | 2/1991 | Davis |
| 5,014,480 | A | 5/1991 | Guarriello et al. |
| 5,028,368 | A | 7/1991 | Grau |
| 5,058,855 | A | 10/1991 | Ward |
| 5,078,360 | A | 1/1992 | Spera |
| 5,124,102 | A | 6/1992 | Serafini |
| 5,216,863 | A | 6/1993 | Nessa et al. |
| 5,243,805 | A | 9/1993 | Fricker |
| 5,265,750 | A | 11/1993 | Whiteley |
| 5,311,718 | A | 5/1994 | Trousilek |
| 5,465,545 | A | 11/1995 | Trousilek |
| 5,489,468 | A | 2/1996 | Davidson |
| 5,491,947 | A | 2/1996 | Kim |
| 5,513,474 | A | 5/1996 | Scharkowski |
| 5,516,863 | A | 5/1996 | Abusleme et al. |
| 5,553,430 | A | 9/1996 | Majnaric et al. |
| 5,591,265 | A | 1/1997 | Tusch |
| 5,608,999 | A | 3/1997 | McNamara |
| 5,625,989 | A | 5/1997 | Brubaker et al. |
| 5,714,045 | A | 2/1998 | Lasa et al. |
| 5,729,944 | A | 3/1998 | De Zen |
| 5,740,648 | A | 4/1998 | Piccone |
| 5,747,134 | A | 5/1998 | Mohammed et al. |
| 5,791,103 | A | 8/1998 | Coolman |
| 5,824,347 | A | 10/1998 | Serafini |
| 5,860,262 | A | 1/1999 | Johnson |
| 5,953,880 | A | 9/1999 | De Zen |
| 5,987,830 | A | 11/1999 | Worley |
| 6,161,989 | A | 12/2000 | Kotani et al. |
| 6,167,669 | B1 | 1/2001 | Lanc |
| 6,167,672 | B1 | 1/2001 | Okitomo |
| 6,185,884 | B1 | 2/2001 | Myers et al. |
| 6,189,269 | B1 | 2/2001 | De Zen |
| 6,212,845 | B1 | 4/2001 | De Zen |
| 6,219,984 | B1 | 4/2001 | Piccone |
| 6,220,779 | B1 | 4/2001 | Warner et al. |
| 6,247,280 | B1 | 6/2001 | Grinshpun et al. |
| 6,387,309 | B1 | 5/2002 | Kojima |
| 6,405,508 | B1 | 6/2002 | Janesky |
| 6,435,470 | B1 | 8/2002 | Lahham et al. |
| 6,435,471 | B1 | 8/2002 | Piccone |
| 6,438,918 | B2 | 8/2002 | Moore et al. |
| 6,530,185 | B1 | 3/2003 | Scott et al. |
| 6,550,194 | B2 | 4/2003 | Jackson et al. |
| 6,588,165 | B1 | 7/2003 | Wright |
| 6,622,452 | B2 | 9/2003 | Alvaro |
| 6,691,976 | B2 | 2/2004 | Myers et al. |
| 6,694,692 | B2 | 2/2004 | Piccone |
| 6,832,456 | B1 | 12/2004 | Bilowol |
| 6,866,445 | B2 | 3/2005 | Semler |
| 6,935,081 | B2 | 8/2005 | Dunn et al. |
| 7,320,201 | B2 | 1/2008 | Kitchen et al. |
| 7,444,788 | B2 | 11/2008 | Morin et al. |
| 7,818,936 | B2 | 10/2010 | Morin et al. |
| 8,707,648 | B2 | 4/2014 | Timko et al. |
| 2003/0005659 | A1 | 1/2003 | Moore, Jr. |
| 2003/0085482 | A1 | 5/2003 | Sincock et al. |
| 2003/0155683 | A1 | 8/2003 | Pietrobon |
| 2004/0010994 | A1 | 1/2004 | Piccone |
| 2004/0093817 | A1 | 5/2004 | Pujol Barcons |
| 2005/0016083 | A1 | 1/2005 | Morin et al. |
| 2005/0016103 | A1 | 1/2005 | Piccone |
| 2006/0179762 | A1 | 8/2006 | Thome et al. |
| 2006/0213140 | A1 | 9/2006 | Morin et al. |
| 2007/0193169 | A1 | 8/2007 | Emblin |
| 2009/0120027 | A1 | 5/2009 | Amend |
| 2009/0229214 | A1 | 9/2009 | Nelson |
| 2009/0269130 | A1 | 10/2009 | Williams |
| 2010/0047608 | A1 | 2/2010 | Seccombe |
| 2010/0050552 | A1 | 3/2010 | David |
| 2010/0071304 | A1 | 3/2010 | Richardson et al. |
| 2010/0251657 | A1 | 10/2010 | Richardson et al. |
| 2011/0131914 | A1 | 6/2011 | Richardson et al. |
| 2012/0056344 | A1 | 3/2012 | Richardson et al. |

(56) References Cited

U.S. PATENT DOCUMENTS

| | | | |
|---|---|---|---|
| 2012/0121337 | A1 | 5/2012 | Richardson et al. |
| 2013/0081345 | A1 | 4/2013 | Sheehy |

FOREIGN PATENT DOCUMENTS

| | | | |
|---|---|---|---|
| CA | 1316366 | | 4/1993 |
| CA | 2097226 | | 11/1994 |
| CA | 2141463 | | 8/1996 |
| CA | 2070079 | | 6/1997 |
| CA | 2170681 | | 8/1997 |
| CA | 2218600 | | 6/1998 |
| CA | 2215939 | | 8/1999 |
| CA | 2226497 | | 10/1999 |
| CA | 2243905 | | 1/2000 |
| CA | 2255256 | | 1/2000 |
| CA | 2244537 | | 2/2000 |
| CA | 2418885 | | 8/2003 |
| CA | 2502343 | | 5/2004 |
| CA | 2502392 | | 5/2004 |
| CA | 2499450 | | 9/2005 |
| CA | 2577217 | | 1/2006 |
| CA | 2629202 | | 4/2008 |
| CA | 2716118 | A1 | 8/2008 |
| CA | 2681963 | | 10/2008 |
| CA | 2751134 | A1 | 12/2011 |
| CH | 317758 | | 1/1957 |
| CN | 2529936 | | 1/2003 |
| DE | 1684357 | | 4/1967 |
| DE | 1812590 | | 6/1970 |
| DE | 2062723 | | 8/1972 |
| DE | 3003446 | | 8/1981 |
| DE | 3234489 | | 3/1984 |
| DE | 3727956 | | 5/1988 |
| DE | 29803155 | | 6/1998 |
| EP | 0025420 | | 3/1981 |
| EP | 0055504 | | 7/1982 |
| EP | 0141782 | | 5/1985 |
| EP | 0757137 | | 2/1997 |
| FR | 0507787 | | 7/1920 |
| FR | 1381945 | | 11/1964 |
| FR | 1603005 | | 4/1971 |
| FR | 2535417 | | 5/1984 |
| FR | 2721054 | | 6/1994 |
| FR | 2717848 | | 9/1995 |
| GB | 137221 | | 1/1920 |
| GB | 779916 | | 7/1957 |
| GB | 1243173 | | 8/1971 |
| GB | 1253447 | | 11/1971 |
| GB | 2141661 | | 1/1985 |
| GB | 2205624 | | 12/1988 |
| JP | 05133028 | | 5/1993 |
| JP | 09041612 | | 2/1997 |
| JP | 2008223335 | | 9/2008 |
| SE | 206538 | | 8/1966 |
| WO | 8204088 | | 11/1982 |
| WO | 9500724 | | 1/1995 |
| WO | 9607799 | | 3/1996 |
| WO | 9635845 | | 11/1996 |
| WO | 9743496 | | 11/1997 |
| WO | 0163066 | | 8/2001 |
| WO | 0173240 | | 10/2001 |
| WO | 03006760 | | 1/2003 |
| WO | 2004088064 | | 10/2004 |
| WO | 2005/040526 | | 5/2005 |
| WO | 2008119178 | | 10/2008 |
| WO | 2009059410 | | 5/2009 |
| WO | 2009092158 | | 7/2009 |
| WO | 2010012061 | A1 | 2/2010 |
| WO | 2010037211 | | 4/2010 |
| WO | 2010078645 | | 7/2010 |
| WO | 2012003587 | | 1/2012 |
| WO | 2013075250 | | 5/2013 |
| WO | 2013102274 | | 7/2013 |
| WO | 2013102275 | | 7/2013 |
| WO | 2013188980 | | 7/2013 |
| WO | 2013177715 | | 12/2013 |

OTHER PUBLICATIONS

Vector Corrosion Technologies Marketing Materials, 2007.

Vector Corrosion Technologies Marketing Materials, 2008.

Digigraph Brochure, Building Systems using PVC extrusions and concrete, accessed online Jan. 2012.

Digigraph Guide, Digigraph Systems Inc., Installation Guide for the Digigraph Construction System Composed of PVC Extrusions and Concrete, accessed online Jan. 2012.

The Digigraph System, http://www.digigraph-housing.com/web/system.ht, accessed online Jan. 2012.

STAY-IN-PLACE FORMWORK WITH ENGAGING AND ABUTTING CONNECTIONS

RELATED APPLICATIONS

This application claims the benefit of the priority of U.S. application No. 61/563,595 filed on 24 Nov. 2011. U.S. application No. 61/563,595 is hereby incorporated herein by reference.

TECHNICAL FIELD

The technology disclosed herein relates to formwork for fabricating structural parts of buildings, tanks and/or other structures out of concrete or other similar curable construction materials. Particular embodiments of the invention provide connector components for modular formworks and methods for providing connections between modular formwork units.

BACKGROUND

Any discussion of the prior art throughout the specification should in no way be considered as an admission that such prior art is widely known or forms part of general common knowledge in the field.

It is known to fabricate structural parts for buildings, tanks or the like from concrete using modular stay-in-place formworks. Such structural parts may include walls, ceilings or the like. Examples of such modular stay in place formworks include those described US patent publication No. 2005/0016103 (Piccone) and PCT publication No. WO96/07799 (Sterling). A representative drawing depicting a partial formwork 28 according to one prior art system is shown in top plan view in FIG. 1. Formwork 28 includes a plurality of wall panels 30 (e.g. 30A, 30B, 30D), each of which has an inwardly facing surface 31A and an outwardly facing surface 31B. Each of panels 30 includes a terminal male T-connector component 34 at one of its transverse, vertically-extending edges (vertical being the direction into and out of the FIG. 1 page) and a terminal female C-connector component 32 at its opposing vertical edge. Male T-connector components 34 slide vertically into the receptacles of female C-connector components 32 to join edge-adjacent panels 30 and to thereby provide a pair of substantially parallel wall segments (generally indicated at 27, 29). Depending on the needs for particular wall segments 27, 29, different panels 30 may have different transverse dimensions. For example, comparing panels 30A and 30B, it can be seen that panel 30A has approximately ¼ of the transverse length of panel 30B.

Formwork 28 includes support panels 36A which extend between, and connect to each of, wall segments 27, 29 at transversely spaced apart locations. Support panels 36A include male T-connector components 42 slidably received in the receptacles of female C-connector components 38 which extend inwardly from inwardly facing surfaces 31A or from female C-connector components 32. Formwork 28 comprises tensioning panels 40 which extend between panels 30 and support panels 36A at various locations within formwork 28. Tensioning panels 40 include male T-connector components 46 received in the receptacles of female C-connector components 38.

In use, formwork 28 is assembled by slidable connection of the various male T-connector components 34, 42, 46 in the receptacles of the various female C-connectors 32, 38. Liquid concrete is then poured into formwork 28 between wall segments 27, 29. The concrete flows through apertures (not shown) in support panels 36 and tensioning panels 40 to fill the inward portion of formwork 28 (i.e. between wall segments 27, 29). When the concrete solidifies, the concrete (together with formwork 28) may provide a structural component (e.g. a wall) for a building or other structure.

A known problem with prior art systems is referred to colloquially as "unzipping". Unzipping refers to the separation of connector components from one another due to the weight and/or outward pressure generated by liquid concrete when it is poured into formwork 28. By way of example, unzipping may occur at connector components 32, 34 between panels 30. FIG. 2 schematically depicts the unzipping of a prior art connection 50 between male T-connector component 34 and corresponding female C-connector component 32 at the edges of a pair of edge-adjacent panels 30. The concrete (not explicitly shown) on the inside 51 of connection 50 exerts outward forces on panels 50 (as shown at arrows 52, 54). These outward forces tend to cause deformation of the connector components 32, 34. In the FIG. 2 example illustration, connector components 32, 34 exhibit deformation in the region of reference numerals 56, 58, 60, 62, 64, 68. This deformation of connector components 32, 34 may be referred to as unzipping.

Unzipping of connector components can lead to a number of problems. In addition to the unattractive appearance of unzipped connector components, unzipping can lead to separation of male connector components 34 from female connector components 32. To counteract this problem, prior art systems typically incorporate support panels 36A and tensioning panels 40, as described above. However, support panels 36A and tensioning panels 40 may not completely eliminate the unzipping problem. Notwithstanding the presence of support panels 36A and tensioning panels 40, in cases where male connector components 34 do not separate completely from female connector components 32, unzipping of connector components 32, 34 may still lead to the formation of small spaces (e.g. spaces 70, 71) or the like between connector components 32, 34. Such spaces can be difficult to clean and can represent regions for the proliferation of bacteria or other contaminants and can thereby prevent or discourage the use of formwork 28 for particular applications, such as those associated with food storage or handling or other applications requiring sanitary conditions or the like. Such spaces can also permit the leakage of liquids and/or gasses between inside 51 and outside 53 of panels 30. Such leakage can prevent or discourage the use of formwork 28 for applications where it is required that formwork 28 be impermeable to gases or liquids (e.g. to provide the walls of tanks used to store water or other liquids). Such leakage can also lead to unsanitary conditions on the inside of formwork 28 and/or cause or lead to corrosion of reinforcement bars (rebar) used in the concrete structure.

In some applications (e.g. in the walls of tanks used to store water or other fluids), there is a desire to maintain a fluid-tight seal at connections between connector components (e.g. connector components 32, 34). Most prior art systems do not provide fluid-tight seals between connector components. Those prior art systems that do provide fluid tight seals can be difficult to work with because of difficulties associated with making and breaking the fluid-tight connections between connector components (which can be desirable during assembly of a formwork or fabrication of a corresponding structure).

Also, some prior art formwork systems can be difficult to assemble. For example, some prior art formwork systems involve making connections by initially orienting the panels at relatively large angles (e.g. orthogonal angles) relative to one another. Again, this can be difficult or impossible in some constrained spaces.

The foregoing examples of the related art and limitations related thereto are intended to be illustrative and not exclusive. Other limitations of the related art will become apparent to those of skill in the art upon a reading of the specification and a study of the drawings.

There remains a general need for effective apparatus and methods for modular formwork systems.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a formwork assembly comprising a plurality of elongated panels connectable to one another in edge-adjacent relationship. The plurality of panels comprises first and second edge-adjacent panels connectable to one another at a connection between a male connector component of the first panel and a female connector component of the second panel. The female connector component comprises a female engagement portion which defines a principal receptacle and the male connector component comprises a male engagement portion which is received in the principal receptacle to form the connection. The female connector component comprises a first abutment portion and the male connector component comprises a second abutment portion which abuts against the first abutment portion to form the connection. The first and second abutment portions comprise corresponding first and second abutment surfaces which are bevelled with respect to outer surfaces of the first and second edge-adjacent panels.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

In drawings which illustrate non-limiting embodiments of the invention.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Particular embodiments of the invention provide formwork assemblies comprising a plurality of elongated panels connectable to one another in edge-adjacent relationship. The plurality of panels comprises first and second edge-adjacent panels connectable to one another at a connection between a male connector component of the first panel and a female connector component of the second panel. The female connector component comprises a female engagement portion which defines a principal receptacle and the male connector component comprises a male engagement portion which is received in the principal receptacle to form the connection. The female connector component comprises a first abutment portion and the male connector component comprises a second abutment portion which abuts against the first abutment portion to form the connection. The first and second abutment portions comprise corresponding first and second abutment surfaces which are bevelled with respect to outer surfaces of the first and second edge-adjacent panels.

Figure 1:
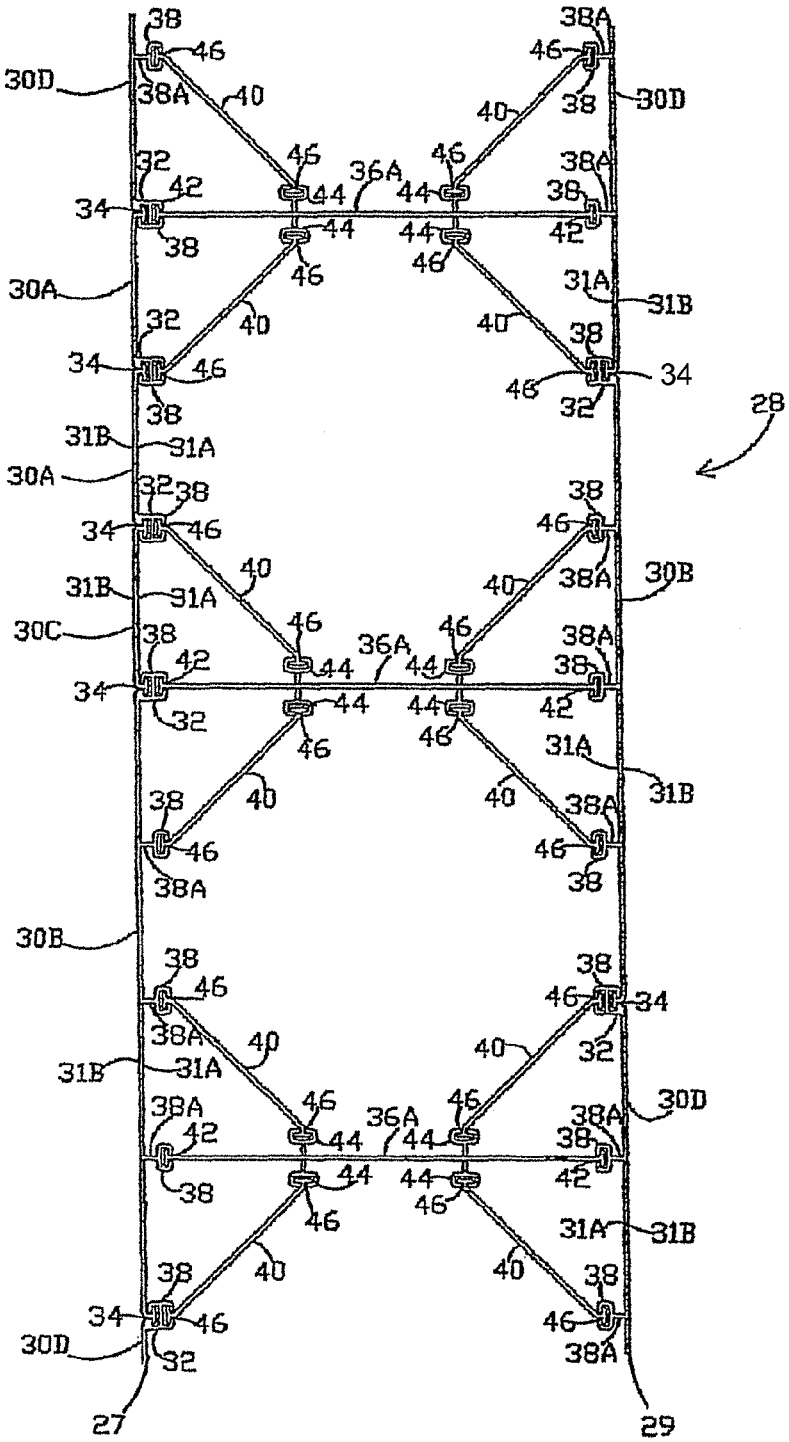
PRIOR ART FIGURE 1
FIG. 1 is a is a top plan view of a prior art modular stay-in-place formwork.
Figure 2:
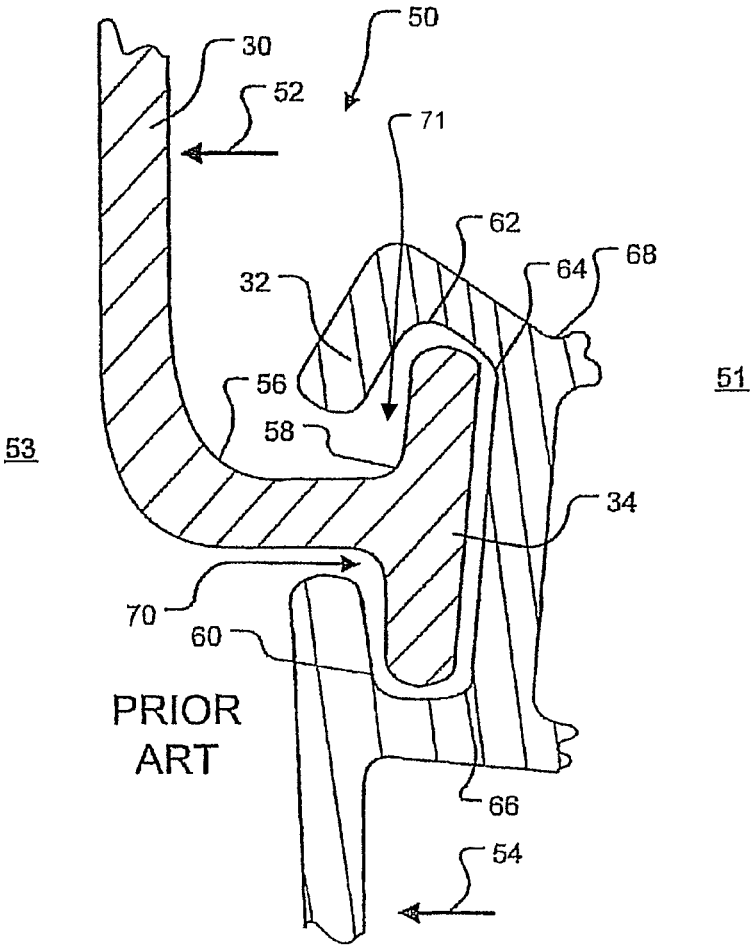
FIG. 2 is a magnified partial top plan view of the FIG. 1 formwork, showing the unzipping of a connection between wall panels.
Figure 3A:
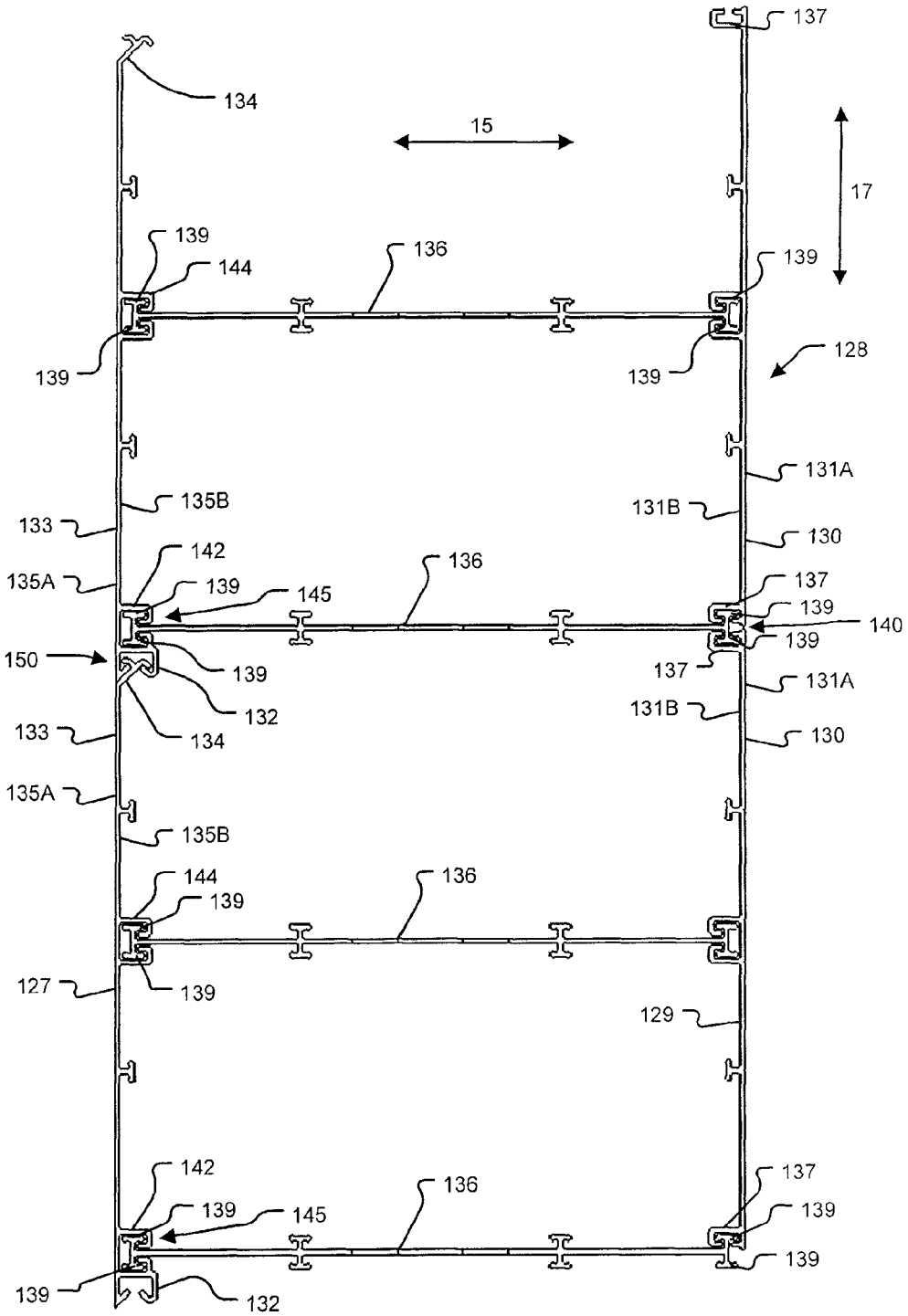
FIG. 3A is a partial cross-sectional view of a modular stay-in-place formwork according to a particular embodiment.

FIG. 3A is a partial cross-sectional view of a modular stay-in-place formwork 128 according to a particular embodiment of the invention which may be used to fabricate a portion of a wall of a building or other structure. Formwork 128 of the FIG. 3A embodiment includes panels 130, 133 and support members 136 which are connected to one another to provide wall segments 127, 129 which, in the illustrated embodiment, extend in the vertical direction (into and out of the page in the FIG. 3A view) and in the transverse direction 17. The components of formwork 128 (i.e. panels 130, 133 and support members 136) are preferably fabricated from a lightweight and resiliently deformable material (e.g. a suitable plastic) using an extrusion process. By way of non-limiting example, suitable plastics include: poly-vinyl chloride (PVC), acrylonitrile butadiene styrene (ABS) or the like. In other embodiments, the components of formwork 128 may be fabricated from other suitable materials, such as steel or other suitable alloys, for example. Although extrusion is the currently preferred technique for fabricating the components of formwork 128, other suitable fabrication techniques, such as injection molding, stamping, sheet metal fabrication techniques or the like may additionally or alternatively be used.

Figure 3B:
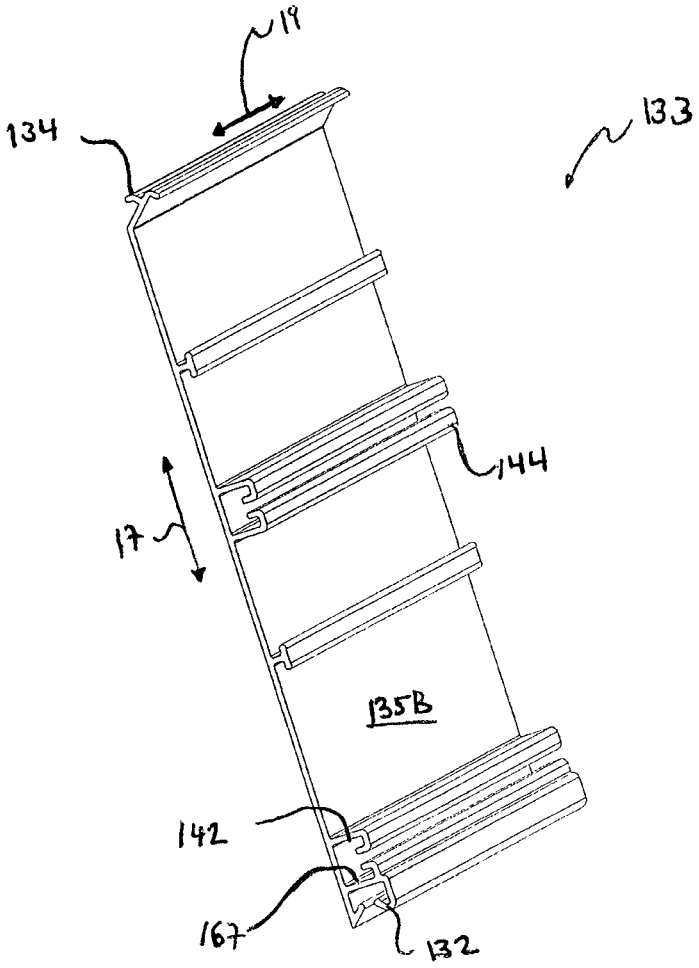
FIGS. 3B and 3C are isometric views of the panels of the FIG. 3A formwork.
Figure 3C:
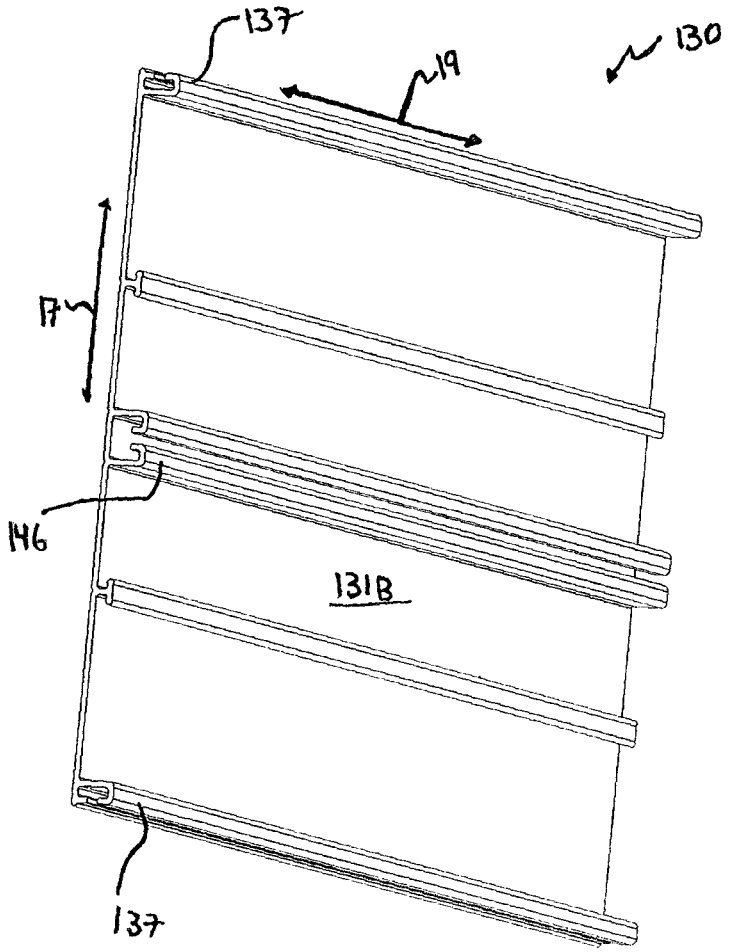

Formwork 128 comprises a plurality of panels 130, 133 which are elongated in the vertical direction (i.e. the direction into and out of the page of FIG. 3A and shown by double-headed arrows 19 in FIGS. 3B and 3C) and which extend in transverse directions 17. Panels 130, 133 respectively comprise outward facing (exterior) surfaces 131A, 135A and inward facing (interior) surfaces 131B, 135B. In the illustrated embodiment, exterior surfaces 131A, 135A are substantially flat, although in other embodiments, exterior surfaces 131A, 135A may be provided with desired shapes (e.g. corrugation or the like). Interior surfaces 131B, 135B comprise a number of features described in more detail below.

In the illustrated embodiment, panels 130, 133 have a substantially uniform cross-section along their entire vertical length, although this is not necessary. In the illustrated embodiment, the transverse dimensions (direction 17) of panels 130, 133 are the same for each of panels 130, 133. This is not necessary. In general, it can be desirable to fabricate panels 130, 133 having a number of different transverse dimensions which may suit particular applications. By way of non-limiting example, panels 130, 133 may be provided with 2, 3, 4 and 6 inch transverse dimensions or such other transverse dimensions as may be appropriate or desirable for particular applications. In some embodiments, panels 130, 133 are prefabricated to have a variety of different vertical dimensions with may be suitable for a variety of different applications. In other embodiments, the vertical dimensions of panels 130, 133 may be made arbitrarily and then panels 130, 133 may be cut to length for different applications. Preferably, panels 130, 133 are relatively thin in the inward-outward direction (shown by double-headed arrow 15 of FIG. 3A) in comparison to the inward-outward dimension of the resultant walls fabricated using formwork 128. In some embodiments, the ratio of the inward-outward dimension of a structure formed by formwork 128 to the inward-outward dimension of a panel 130, 133 is in a range of 10-600. In some embodiments, the ratio of the inward-outward dimension of a structure formed by formwork 128 to the inward-outward dimension of a panel 130, 133 is in a range of 20-300.

In the FIG. 3A embodiment, panels 130, 133 are different from one another in the manner that edge-adjacent panels 130, 133 connect to one another to provide wall segments 127, 129. In other embodiments, both wall segments 127, 129 may be comprise the same types of panels. For example, wall segment 129 may be provided by panels 133 in the place of panels 130.

Panels 133 incorporate first, generally female, connector components 132 at one of their transverse edges and second, generally male, connector components 134 at their opposing transverse edges. As shown in FIG. 3A and explained further below, connector components 132, 134 are complementary to one another such that connector components 132, 134 of edge-adjacent panels 133 may be joined together to form connections 150 between edge-adjacent panels 133. Panels 133 may be connected in edge-adjacent relationship to provide wall segment 127.

Panels 130 of the illustrated embodiment incorporate generally C-shaped, female connector components 137 at both of their transverse edges. Connector components 137 are connected to complementary T-shaped, male connector components 139 at the inner or outer edges of support members 136 so as to form connections 140 which connect panels 130 in edge-adjacent relationship and to thereby provide wall segment 129. Connector components 137 of panels 130 and connector components 139 of support members 136 may be connected to one another by slidably inserting male connector components 139 into female connector components 137. In other embodiments, connector components 137, 139 may be different than those shown in the illustrated embodiment and may connect to one using techniques other than relative sliding, such as, by way of non-limiting example, deformable "snap-together" connections, pivotal connections, push on connections and/or the like. In some embodiments, panels 130 may be provided with male connector component and support members 136 may comprise female connector components.

Figure 3D:
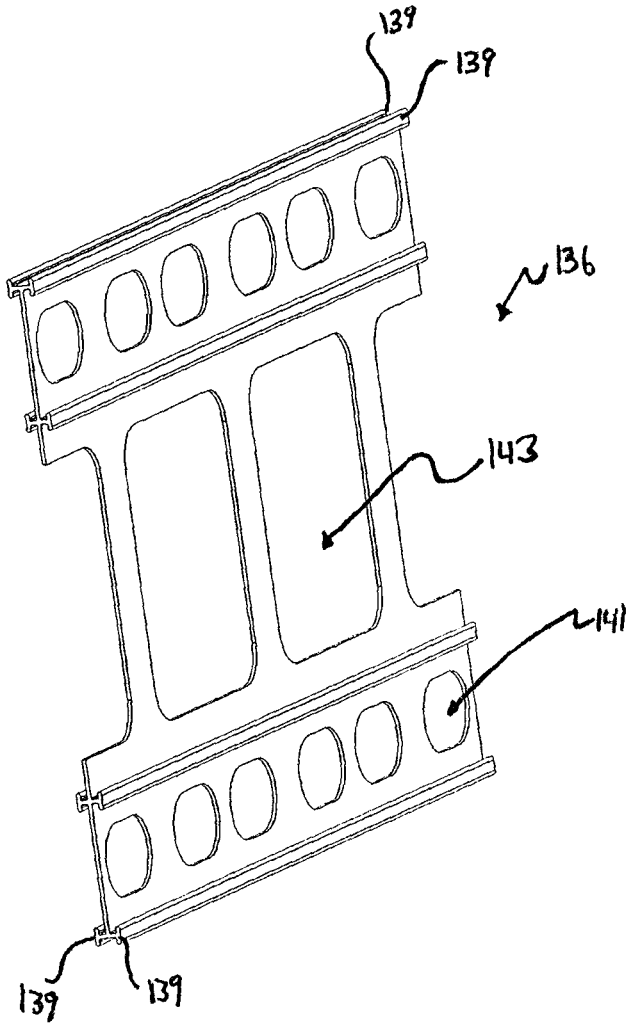
FIG. 3D is an isometric view of a support member of the FIG. 3A formwork.

FIG. 3D shows a support member 136 according to a particular embodiment. Support members 136 comprise a number of apertures 141, 143 which permit a flow of liquid concrete therethrough. As mentioned above, support member 136 comprises a pair of connector components 139 at each of its inner and outer edges. In the illustrated embodiment, connector components 139 each comprise male, T-shaped connector components. Like panels 130, 133, support members 136 may be fabricated to have a number of vertical lengths or may be cut to desired lengths. Further, support members 136 may be made to have different width dimensions (see arrow 15 of FIG. 3A) so as to provide formwork 128 with different width dimensions, suitable for different applications.

Panels 133 comprise a connector component 142 which is complementary to the pair of connector components 139 of support members 136. In the illustrated embodiment, connector components 142 of panels 133 comprise "double-J" shaped, female connector components that slidably receive T-shaped connector components 139 of support members 136 to provide connections 145 between support members 136 and panels 133. In other embodiments, connector components 139, 142 may be different than those shown in the illustrated embodiment and may connect to one using techniques other than relative sliding, such as, by way of non-limiting example, deformable "snap-together" connections, pivotal connections, push on connections and/or the like. In some embodiments, panels 133 may be provided with male connector component and support members 136 may comprise female connector components.

Connector components 142 may be located relatively close to one of the transverse edges of panels 133. In the illustrated embodiment, connector components 142 are located relatively close to the transverse edges of panels 133 which include connector components 132. In the particular case of the illustrated embodiment, connector components 142 are immediately adjacent connector components 132 and connector components 142, 132 share a connector wall portion 167 with one another. The proximity of connector components 142 to one of the transverse edges of panels 133 means that connections 145 between panels 133 and support members 136 are also located relatively close to one of the transverse edges of panels 133, such that support members 136 reinforce connections 150 between edge-adjacent panels 133.

Support members 136 may also optionally be connected to panels 130, 133 at locations away from their transverse edges, as is shown in the FIG. 3A embodiment. In the FIG. 3A embodiment, panels 133 comprise interior connector components 144 which are complementary to a pair of connector components 139 on the edges of support panels 136 and panels 130 comprise interior connector components 146 which are complementary to a pair of connector components 139 on the edges of support panels 136. In the illustrated embodiment, interior connector components 144, 146 comprise "double-J" shaped, female connector components that slidably receive T-shaped connector components 139 of support members 136. In other embodiments, connector components 139, 144, 146 may be different than those shown in the illustrated embodiment and may connect to one using techniques other than relative sliding, such as, by way of non-limiting example, deformable "snap-together" connections, pivotal connections, push on connections and/or the like. In some embodiments, panels 133, 130 may be provided with male connector component and support members 136 may comprise female connector components.

In the illustrated embodiment, panels 133, 130 respectively comprise one interior connector component 144, 146 which is generally centrally located along the transverse dimension of panels 133, 130. In other embodiments, panels 133, 130 may be provided with different numbers (e.g. zero or a plurality) of interior connector components 144, 146 which may depend on the transverse (direction 17) width of panels 133, 130 and/or the strength requirements of a particular application. It will be understood that the mere provision of connector components 144, 146 on panels 133, 130 does not mean that support members 136 must be connected to these panels.

Figure 4A:
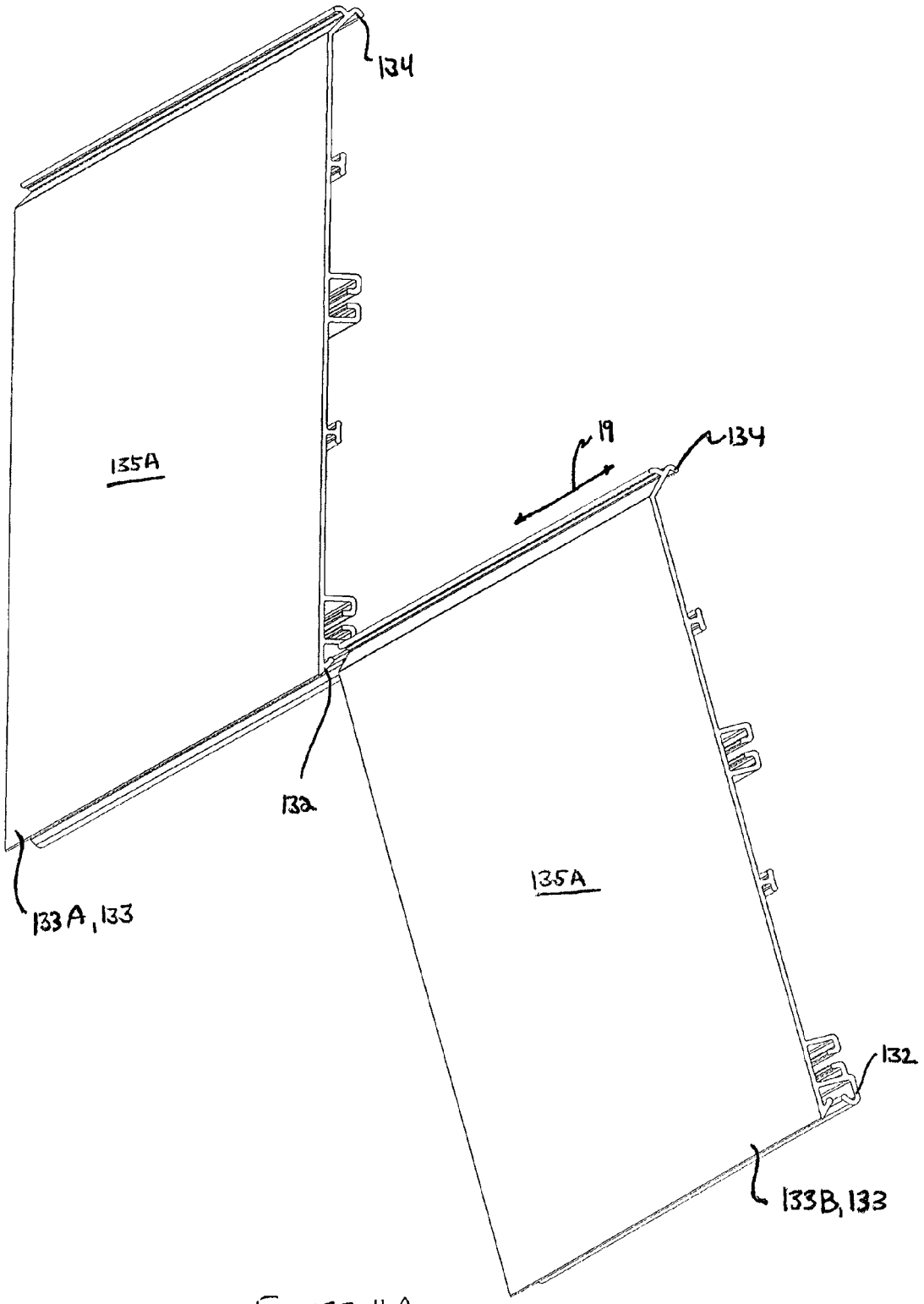
FIGS. 4A-4D show schematic views of a method for making connection between the complementary connector components of a pair of edge-adjacent panels of the FIG. 1 formwork.
Figure 4B:
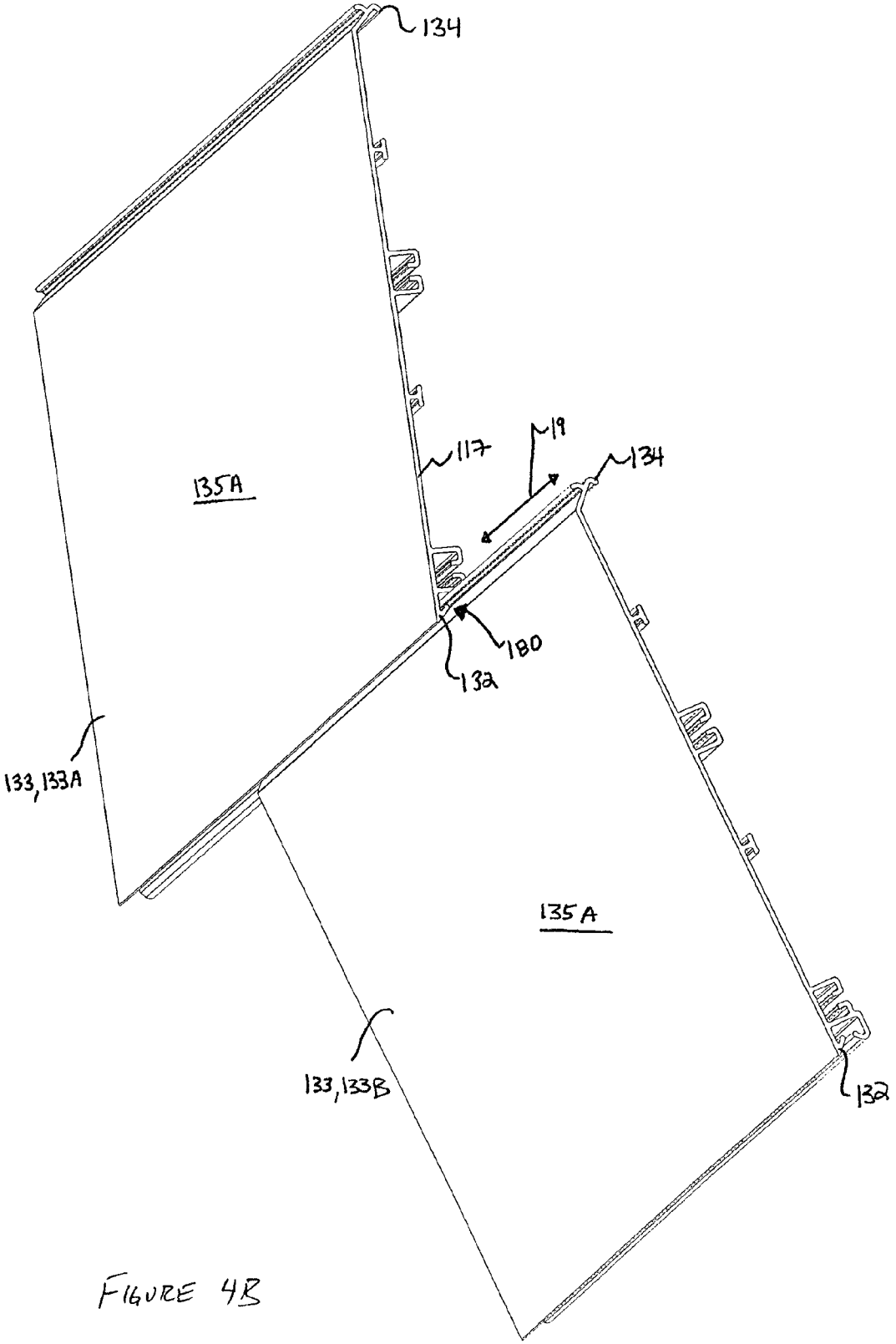
Figure 4C:
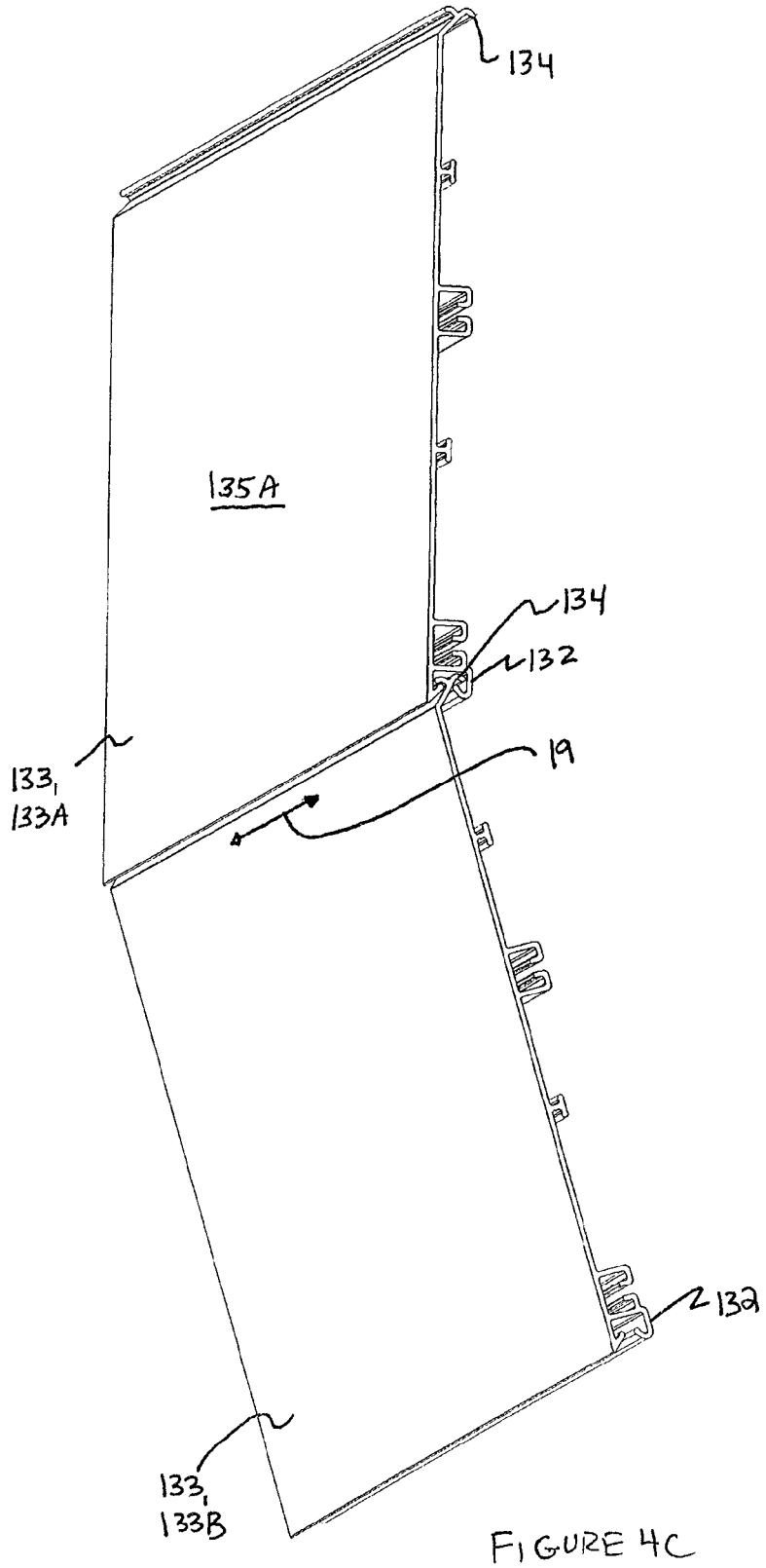
Figure 4D:
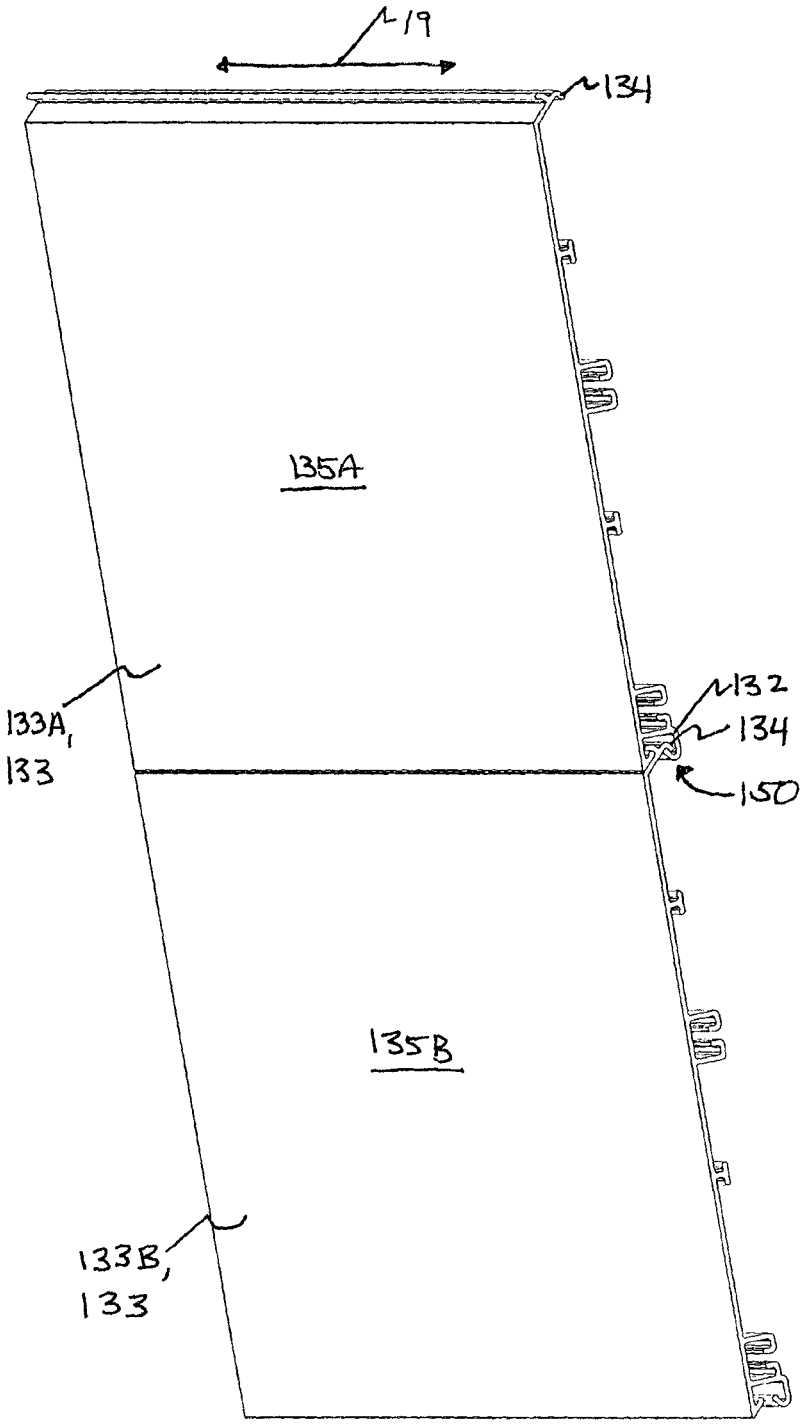

FIGS. 4A-4D show schematic views of a method for making a connection 150 between female connector component 132 and male connector component 134 of edge adjacent panels 133 of formwork 128. In the illustrated embodiment, connection 150 may be formed between edge-adjacent panels 133A, 133B by positioning panels 133A, 133B so that their complementary connector components 132, 134 are aligned with one another at an oblique angle (FIG. 4A), moving panels 133A, 133B relative to one another in direction 19 such that complementary connector components 132, 134 slideably engage one another in a relatively loose-fit connection 180 (FIG. 4B), continuing to move panels 133A, 133B relative to one another at the oblique angle with connector components 132, 134 in loose-fit connection 180 until panels 133A, 133B are aligned in direction 19 (FIG. 4C) and then pivoting panels 133A, 133B relative to one another about an axis generally parallel with direction 19 to move panels 133A, 133B into a generally flattened orientation (FIG. 4D). It will be appreciated that while described as a vertical direction, direction 19 may generally be any direction depending on the desired orientation of panels 133A, 133B during assembly. Panels 133A, 133B may be engaged in loose-fit connection 180 (FIG. 4B) by insertion of male connector component 134 into female connector component 132 at an end 117 of panel 133A, for example.

Figure 4E:
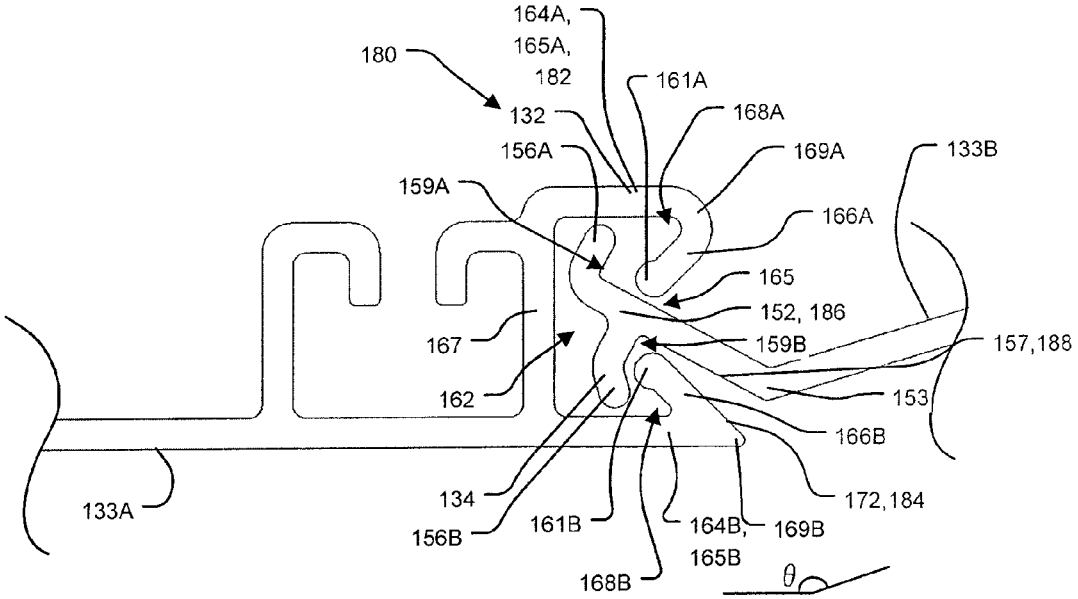
FIGS. 4E and 4F are magnified partial cross-sectional views of the FIG. 3A formwork showing a connection between edge-adjacent panels.
Figure 4F:
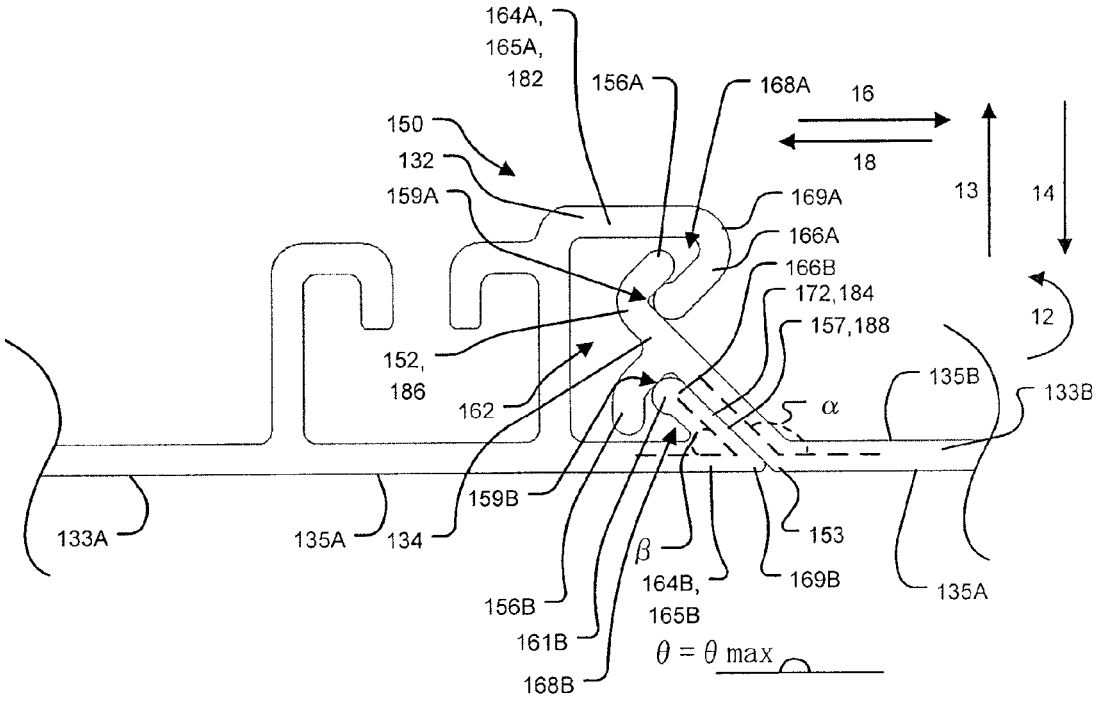

FIGS. 4E and 4F respectively show enlarged partial plan views of connector components 132, 134 when edge-adjacent panels 133A, 133B in the loose-fit connection 180 (FIG. 4C) and when edge-adjacent panels 133A, 133B have been flattened to provide connection 150 (FIG. 4D). Each of connector components 132, 134 comprises an engagement portion and an abutment portion. More particularly, female connector component 132 comprises an engagement portion 182 and an abutment portion 184 and male connector component 134 comprises an engagement portion 186 and an abutment portion 188. When connector components 132, 134 are in loose-fit connection 180 of FIG. 4E, engagement portions 182, 186 of connector components 132, 134 are engaged with one another, but there is no substantial contact or friction between abutment portions 184, 188. When connector components 132, 134 are moved into connection 150, engagement portions 182, 186 remain engaged with one another, but abutment portions 184, 188 are also brought into contact with one another to complete connection 150.

Connector components 132, 134 may be shaped such that loose-fit connection 180 (FIGS. 4B, 4C, 4E) may effected by engaging engagement portions 182, 186 of the respective connector components 132, 134 to one another (by inserting male engagement portion 186 into female engagement portion 182) without abutting abutment portions 184, 188 against one another. Connector components 132, 134 may be shaped such that loose-fit connection 180 may be effected without substantial deformation of, or friction between, connector components 132, 134. More particularly, when in loose-fit connection 180, male engagement portion 186 of connector component 134 may be located in female engagement portion 182 of connector component 132 without substantial contact or friction between engagement portions 182, 186 (see FIG. 4E) and abutment portions 184, 188 of connector components 132, 134 are not in contact with one another. This lack of friction and deformation when connector components 132, 134 are in loose-fit connection 180 may facilitate easy relative sliding motion between connector components 132, 134, even where panels 133A, 133B are relatively long in direction 19 (e.g. the length of one or more stories of a building).

In some embodiments, as shown in FIG. 4E for example, the relative interior angle θ between the transverse extensions (e.g. exterior surfaces 135A) of panels 133A, 133B when connector components 132, 134 are in loose-fit connection 180 and at the aforementioned oblique angle is in a range of 120°-179°. In other embodiments, this angular orientation θ between panels 133A, 133B is in a range of 165°-179°. In still other embodiments, this angular orientation θ between panels 133A, 133B when connector components 132, 134 are in loose-fit connection 180 is in a range of 175°-179°. Allowing for sliding movement between the panels at a range of oblique orientation angles θ allows for more flexibility in assembling a formwork. This flexibility may be because some play or movement is permitted between panels 133A, 133B both in direction 19 and pivotally (e.g. about an axis parallel to direction 19), which allows for adjustments to be made when installing support members 136 or reinforcing bars (rebar). Also, allowing for sliding movement between the panels at a range of oblique orientation angles θ allows edge adjacent panels 133A, 133B to be assembled in more confined environments by adjusting the oblique orientation angle θ as desired to fit within the confined environment.

As discussed above, once panels 133A, 133B have been moved in direction 19 into a desired alignment (FIG. 4C) they may be flattened (FIG. 4D) to complete connection 150. Flattening panels 133A, 133B to move between loose-fit connection 180 (FIGS. 4C, 4E) and connection 150 (FIGS. 4D, 4F) may involve pivoting panels 133A, 133B relative to one another about an axis generally parallel with direction 19 (into and out of the page in the view of FIGS. 4E and 4F) to increase the interior angle θ between the transverse extensions of panels 133A, 133B and to bring abutment portions 184, 188 of connector components 132, 134 into contact with one another. For example, flattening panels 133A, 133B may involve increasing the interior angle θ between exterior surfaces 135A of panels 133A, 133B prior to introduction of concrete and/or prior to connection of support members 136 to panels 133A, 133B. Forming connection 150 (FIG. 4F) involves increasing the interior angle θ between edge-adjacent panels 133A, 133B until abutment portions 184, 188 of connector components 132, 134 are pressed into contact with one another. As explained in more detail below, abutment portions 184, 188 may respectively comprise abutment surfaces 172, 157 which may be bevelled at angles that are complementary to one another when connection 150 is formed.

A detailed description of the formation of connection 150 is now provided, with reference to FIGS. 4E and 4F. In the illustrated embodiment, engagement portion 182 of female connector component 132 comprises back wall 167 and a pair of retaining arms 164A, 164B (collectively, retaining arms 164) which define a principal receptacle 172 having a mouth 165 and engagement portion 186 of male connector components 134 comprises a splayed protrusion 152. In the illustrated embodiment, abutment portion 184 of female connector component 132 comprises bevelled abutment surface 172 and abutment portion 188 of male connector component 134 comprises bevelled abutment surface 157.

As shown in FIG. 4E, loose-fit connection 180 may be formed by engaging engagement portion 186, 182 of connector components 132, 134—e.g. by inserting male engagement portion 186 of connector component 134 into female engagement portion 182 of connector component 134 to thereby engage engagement portions 182, 186. More particularly, in the illustrated embodiment, loose-fit connection 180 is formed by slidably inserting splayed protrusion 152 of male engagement portion 186 of connector component 134 into principal receptacle or recess 162 of female engagement portion 182 of connector component 132. As discussed above, the insertion of splayed protrusion 152 into principal receptacle 162 to provide loose-fit connection 180 may be made without substantial deformation of connector components 132, 134 and/or without substantial friction therebetween. Furthermore, when loose-fit connection 180 is made, panels 133A, 133B (and connector components 132, 134) may be arranged such that panels 133A, 133B may be moved relative to one another without substantial friction between, or deformation of, connector components 132, 134.

As shown in FIG. 4E, retaining arms 164 of female engagement portion 182 of connector component 132 respectively comprise upper arms 165A, 165B (collectively, upper arms 165) which project away from back wall 167 of connector component 132 and angled forearms 166A, 166B (collectively, forearms 166) which project from the ends of upper arms 165 back toward back wall 167 to provide convex elbows 169A, 169B (collectively, elbows 169) and concave hooks 168A, 168B (collectively, hooks 168). As explained in more detail below, hooks 168 may engage fingers 156 of male engagement portion 186 of connector component 134.

In the illustrated embodiment, bevelled abutment surface 172 of abutment portion 184 of connector component 132 is also provided by forearm 166B. Forearms 166 may comprise convex or rounded phalanges 161A, 161B (collectively, phalanges 161). Phalanges 161 may allow splayed protrusion 152 to pivot upon them while connections 150, 180 are being formed. Back wall 167 may provide support for engagement portion 182 of female connector component 132 and, in the illustrated embodiment, may also provide a connector wall portion of connector component 142, discussed above. When panels 133A, 133B are in the connected configuration 150 of FIG. 4F, elbow 169B may be generally aligned with knee 153 of connector component 134 and abutment surface 172 of abutment portion 184 of female connector component 132 may abut against abutment surface 157 of abutment portion 188 of male connector component 134 to provide exterior surfaces 135A of panels 133A, 133B with a substantially flat surface. In the illustrated embodiment, interior bevel angle β between abutment surface 172 and exterior surface 135A of panel 133A is approximately 45°, although this is not necessary and interior bevel angle β may have any suitable angle that is more or less than 45°.

As mentioned briefly above, engagement portion 186 of male connector component 134 of the illustrated embodiment comprises splayed protrusion 152 having fingers 156A, 156B (collectively, fingers 156). Fingers 156 may be sized and/or shaped so as to not deform, or create substantial friction with, engagement portion 182 of female connector component 134 when connector components 132, 134 are in loose-fit connection 180 (FIG. 4E). In the illustrated embodiment, fingers 156 are shaped to provide concave hooks 159A, 159B (collectively, hooks 159), which have concavities that are oriented generally away from the concavities of hooks 168 of connector component 132 when connection 150 (FIG. 4F) is formed. Male connector component 134 also comprises an abutment portion 188, which in the illustrated embodiment, comprises a bevelled abutment surface 157. When panels 133A, 133B are in the connected configuration 150 of FIG. 4F, abutment surface 157 of abutment portion 188 of male connector component 134 may abut against abutment surface 172 of abutment portion 184 of female connector component 132 to provide exterior surfaces 135A of panels 133A, 133B with a substantially flat surface. In the illustrated embodiment, interior bevel angle α between abutment surface 157 and exterior surface 135A of panel 133B is approximately 45°, although this is not necessary and interior bevel angle α may have any suitable angle that is more or less than 45°.

When panels 133A, 133B are flattened from loose-fit connection 180 (FIG. 4E) to connection 150 (FIG. 4F), knee 153 of connector component 134 may become proximate to elbow 169B of connector component 132. Also, abutment surface 157 of abutment portion 188 of connector component 134 may abut against abutment surface 172 of abutment portion 184 of connector component 132 to provide a sealable abutment connection between connectors 132 and 134. Further, hooks 159A, 168A and hooks 159B, 168B may engage one another when connection 150 is formed between connector components 132, 134.

When connector components 132, 134 are flattened to bring abutment surfaces 157, 172 of abutment portions 188, 184 into contact with one another and to thereby provide connection 150 (FIG. 4E), connector components 132, 134 are shaped to provide several interleaving parts. The interleaving parts of components 132, 134 may provide connection 150 with a resistance to unzipping and may prevent or minimize leakage of fluids (e.g. liquids and, in some instances, gases) through connection 150.

In the FIG. 4F embodiment, the interleaving parts comprise hooks 168A, 159A, hooks 168B, 159B and abutment surfaces 172, 157. In particular, the interaction between hooks 168A, 159A acts to prevent relative movement in directions 13, 14 and 16; the interaction between hooks 168B, 159B acts to prevent relative movement in directions 14, 16, and 18; the interaction between abutment surfaces 172, 157 acts to prevent relative movement in directions 14 and 18 (see FIG. 4F). These interleaving components help to prevent unzipping of connection 150 under the pressure provided by the weight of liquid concrete and helps to provide a seal that minimizes leakage of fluids through connection 150.

In particular, when a curable material, such as liquid concrete, is introduced into a formwork comprising panels 133A, 133B, it exerts a pressure on panels 133A, 133B which is generally oriented in direction 14. This pressure asserts corresponding force on the abutment engagement between bevelled abutment surfaces 172, 157 of abutment portions 184, 188 of connector components 132, 134 and thereby helps to prevent leakage of fluids through connection 150. Furthermore, because of the angle of abutment surfaces 172, 157, the pressure of liquid construction material (e.g. concrete) oriented in direction 14 causes hooks 168A, 159A and hooks 168B, 159B to pull toward one another, thereby further engaging hooks 168A, 159A and hooks 168B, 159B. Accordingly, the pressure associated with introducing the curable construction material into the formwork actually reinforces connection 150 by causing hooks 168A, 159A and hooks 168B, 159B to be further engaged in this manner.

Figure 5A:
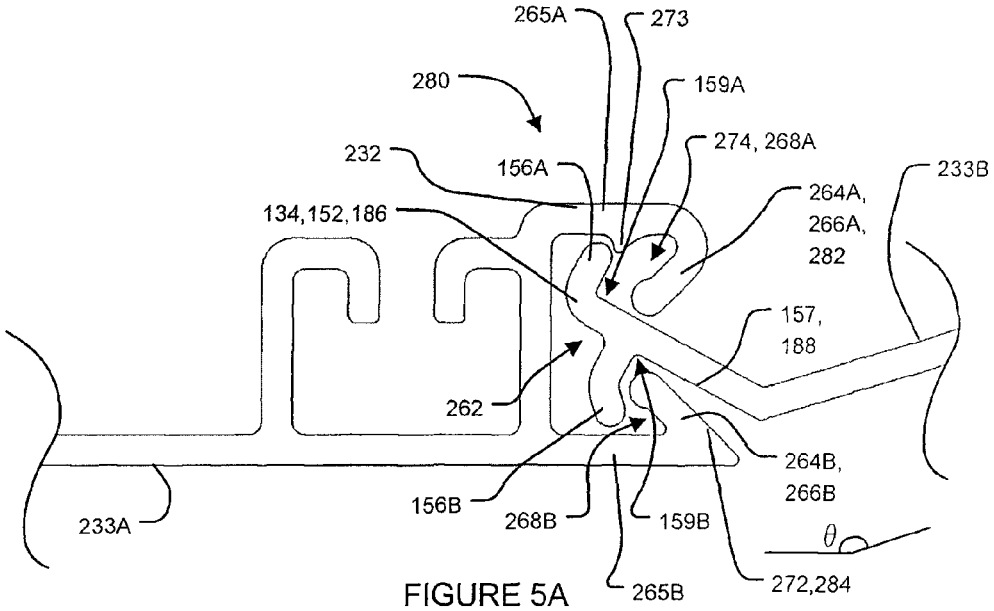
FIGS. 5A and 5B respectively show enlarged partial plan views of a loose-fit connection and a completed connection between a pair of edge-adjacent panels and their respective connector components according to another embodiment.
Figure 5B:
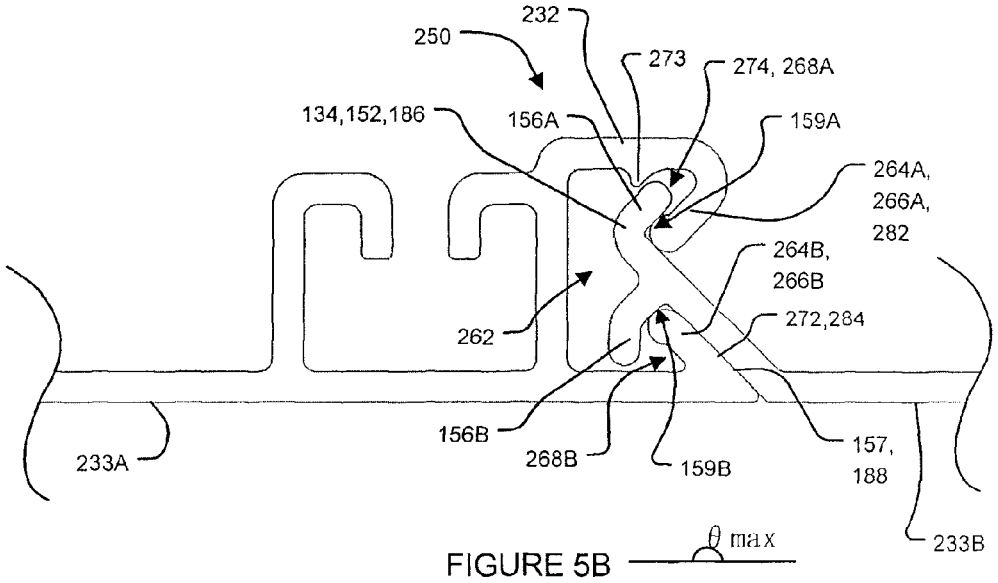

FIGS. 5A and 5B respectively show enlarged partial plan views of a loose-fit connection 280 and a completed connection 250 between a pair of edge-adjacent panels 233A, 233B and their respective connector components 232, 134 according to another embodiment. Connector component 134 of panel 233B may be substantially identical to connector component 134 of panel 133 described above and may comprise engagement portion 186 and abutment portion 188 that are substantially identical to the corresponding portions of connector component 134 of panel 133 described above. Connector component 232 of panel 233A may be similar to connector component 132 of panel 133 described above and similar reference numbers are used to refer to features of connector components 232, 132 except that the reference numbers of connector component 232 are preceded by the numeral "2" whereas the reference numbers of connector component 132 are preceded by the numeral "1". Connector components 232 of panel 233A comprises engagement portion 282 and abutment portion 284.

Connector component 232 differs from connector component 132 in that engagement portion 282 of connector component 232 comprises a projection 273. In the illustrated embodiment, projection 273 projects from upper arm 265A toward upper arm 265B—i.e. into principal recess 262. Projection 273 is shaped to provide resistance to flattening panels 233A, 233B (e.g. to moving panels 233A, 233B from loose-fit connection 280 (FIG. 5A) to completed connection 250 (FIG. 5B)) by resisting movement of finger 156A toward the concavity 274 of hook 268A. When additional force (or torque) is applied to pivot panels 233A, 233B relative to one another and to increase the interior angle θ between panels 233A, 233B, finger 156A pushes against protrusion 273, causing resilient deformation of one or both of connector components 134, 232 (e.g. finger 156A and/or restraining arm 264A) until finger 156A slides past protrusion 273 and into concavity 274 of hook 268A.

The resilient deformation of one or both of connector components 134, 232 caused by the relative pivotal motion of panels 233A, 233B and the movement of finger 156A against protrusion 273 create restorative deformation forces (i.e. forces that tend to restore connector components 134, 232 to their original, non-deformed configuration). As finger 156A moves past protrusion 273 with the continued relative pivotal movement of panels 233A, 233B, these restorative deformation forces tend to force finger 156A into concavity 274 of hook 268A. The action of these restorative deformation forces provides a so-called "snap-together" fitting between connector components 134, 232. When finger 256A projects into concavity 274 of hook 268A to provide connection 250 (FIG. 5B), finger 156A is locked in place and is prevented from movement back toward principal recess 262 by protrusion 273. Accordingly, when connection 250 is made the angle θ between the transverse dimensions of panels 233A, 233B is held at or near to whatever maximum angle is permitted by the shape of connector components 232, 134.

In other embodiments (not shown), a surface of protrusion 273 and/or a surface of finger 156A may be provided with one or more surface features which may tend to prevent the withdrawal of finger 156A from concavity 274 of hook 268A—i.e. to lock finger 156A in concavity 274 of hook 268A. Such surface features may comprise complementary barbs, complementary ridges and/or the like.

In other respects, panels 233A, 233B, their connector components 232, 134 and their connections 280, 250 are substantially similar to panels 133A, 133B, connector components 132, 134 and connections 180, 150 described herein and any reference to panels 133A, 133B, connector components 132, 134 and connections 180, 150 should be understood to be applicable (where appropriate) to panels 233A, 233B, connector components 232, 134 and connections 280, 250.

As discussed above, moving edge-adjacent panels 133A, 133B between loose-fit connection 180 (FIG. 4E) and completed connection 150 (FIG. 4F) may involve pivoting panels 133A, 133B relative to one another about an axis generally parallel with direction 19 (into and out of the page in the view of FIGS. 4E and 4F) to increase the interior angle θ between the transverse extensions of panels 133A, 133B. A maximum angle $\theta=\theta_{max}$ between the transverse extension of panels 133A, 133B (e.g. between exterior surfaces 135A of panels 133A, 133B) may be defined where $\theta_{max}$ is equal to the maximum angle between the transverse extensions of panels 133A, 133B (e.g. the exterior surfaces 135A of panels 133A, 133B) without deformation of panels 133A, 133B. In the case of the illustrated embodiment of FIGS. 4E and 4F, $\theta_{max}$ is equal to a sum of an interior bevel angle β at which abutment surface 172 is bevelled with respect to exterior surface 135A of panel 133A and an interior bevel angle α at which abutment surface 157 is bevelled with respect to outer surface 135A of panel 133B (see FIG. 4F). Referring to FIGS. 4E and 4F, the maximum angle $\theta=\theta_{max}$ may occur when there is complementary contact between abutment portions 184, 188 of connector components 132, 134 or, more particularly in the case of the illustrated embodiment, the abutment of bevelled abutment surfaces 172, 157.

In some embodiments, like the illustrated embodiment of FIGS. 4E and 4F, where it is desired that panels 133A, 133B join together to provide a flat surface (e.g. a flat wall where outer surfaces 135A of panels 133A, 133B are generally parallel with one another), the sum of interior bevel angle β of abutment surface 172 and interior bevel angle α of abutment surface 157 is approximately 180°, so that $\theta_{max}\approx180°$. In the particular case of the embodiment of FIGS. 4E and 4F, abutment surface 172 is bevelled at an interior bevel angle β of approximately 45° and abutment surface 157 is bevelled at an interior bevel angle α of approximately 135°, so that $\theta_{max}\approx180°$. In other embodiments, it may be desirable that the value of $\theta_{max}$ be something other than 180°. For example, in some cases where it is desired that panels 133A, 133B join together to provide a convex surface (e.g. a curved wall where outer surfaces 135A of panels 133A, 133B form a convex surface across connection 150), the value of $\theta_{max}$ be less than 180° (e.g. in a range between 160° and 179°). Conversely, in some cases where it is desired that panels 133A, 133B join together to provide a concave surface (e.g. a curved wall where outer surfaces 135A of panels 133A, 133B form a concave surface across connection 150), the value of $\theta_{max}$ be greater than 180° (e.g. in a range between 181° and 200°).

Figure 6A:
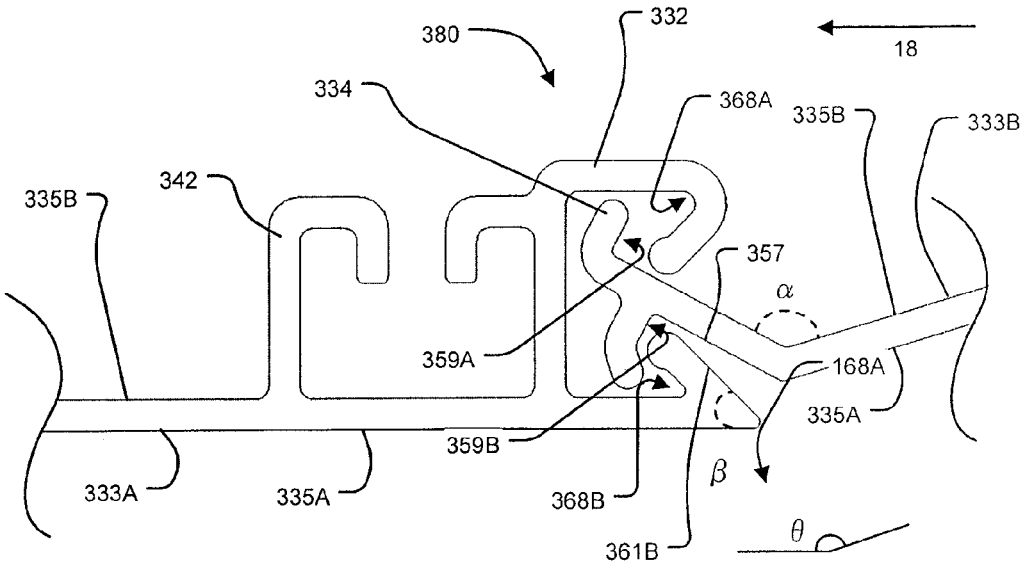
FIGS. 6A and 6B respectively show enlarged partial plan views of a loose-fit connection and a completed connection between a pair of edge-adjacent panels and their respective connector components according to another embodiment.
Figure 6B:
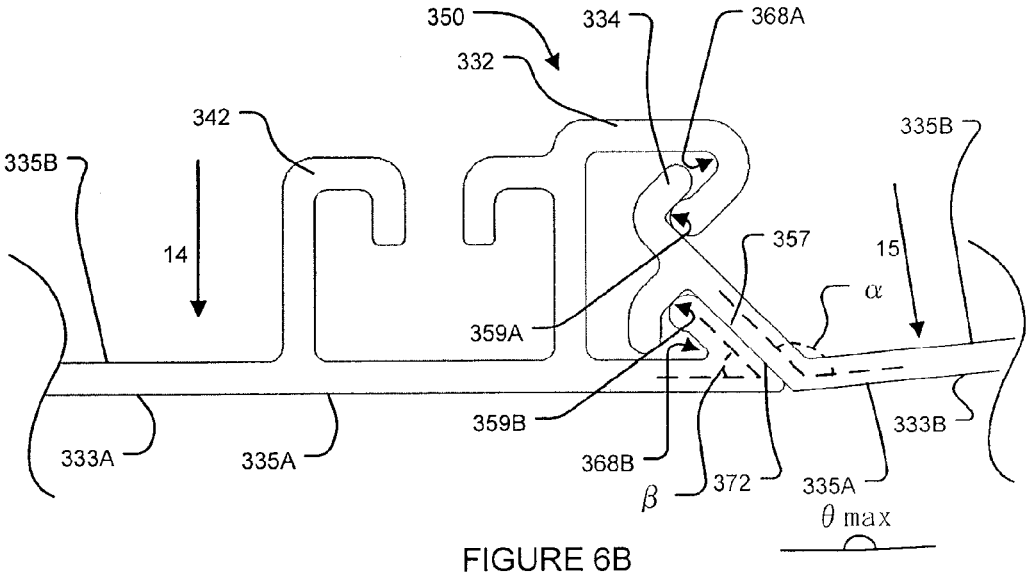

In some embodiments, it may be desirable to provide $\theta_{max}$ with a value that is less than the desired ultimate angle $\theta_{desired}$ between outer surfaces 135A of panels 133A, 133B. This may be accomplished, for example, by providing interior bevel angle β and/or interior bevel angle α of the abutment surfaces at other angles such that the sum of interior bevel angle β and interior bevel angle α (i.e. $\theta_{max}$) is less than the desired ultimate angle $\theta_{desired}$. Such an embodiment is shown in FIGS. 6A and 6B, which respectively depict enlarged partial plan views of a loose-fit connection 380 and a completed connection 350 between a pair of edge-adjacent panels 333A, 333B and their respective connector components 332, 334 according to another embodiment. Panels 333A, 333B may be similar to the above-described panels 133A, 133B and similar reference numbers are used to refer to features of panels 333A, 333B and 133A, 133B except that the reference numbers of panels 333A, 333B are preceded by the numeral "3" whereas the reference numbers of panels 133A, 133B are preceded by the numeral "1".

Panels 333A, 333B differ from panels 133A, 133B only in that $\theta_{max}$, which is provided by the sum of interior bevel angle β and interior bevel angle α of abutment surfaces 372, 357, is less than the desired ultimate angle $\theta_{desired}$. In the case of the FIGS. 6A and 6B embodiment, the desired ultimate angle $\theta_{desired}$=180°, but this is not necessary and the desired ultimate angle $\theta_{desired}$ may be greater than 180° (e.g. for concave walls) or less than 180° (e.g. for convex walls). In the particular case of the embodiment of FIGS. 6A and 6B interior bevel angle β of abutment surface 372 is still approximately 45° while interior bevel angle α of abutment surface 357 has been reduced to approximately 133°. Accordingly, $\theta_{max}$≈178°. In some embodiments, $\theta_{max}$ (the sum of bevel angles α, β) may be designed to be in a range of 95-99.5% of the value of the desired ultimate angle $\theta_{desired}$. In still other embodiments, $\theta_{max}$ may be in a range of 97-99.5% of the value of the desired ultimate angle $\theta_{desired}$. Since $\theta_{max}$ represents the sum of the bevel angles α and β, it will be appreciated that selection of a value for $\theta_{max}$ may be accomplished by varying either or both of bevel angles α and β.

Obtaining the desired ultimate angle $\theta_{desired}$ may involve forcing abutment surfaces 157, 172 into one another with such force that the force causes deformation of panels 333A, 333B (or more particularly, connector components 332, 334) so that the interior angle between panels 333A, 333B increases from $\theta_{max}$ to $\theta_{desired}$. Such force may be applied when support members 136 are connected to panels 333A, 333B, for example. For example, when $\theta_{max}$ is less than $\theta_{desired}$ and support members 136 are connected to panels 333A, 333B, outwardly directed force may be applied to panels 333A, 333B, such that one or both of panels 333A, 333B may tend to deform under the forces caused this pressure in the direction of arrow 15. This deformation may cause exterior surfaces 335A of panels 333A, 333B to become relatively more parallel with one another—i.e. so that the angle between the exterior surfaces 335A of panels 333A, 333B changes from $\theta_{max}$ (prior to connection of support members 136) to a value closer to the desired ultimate angle $\theta_{desired}$ (after the connection of support members 136). Accordingly, selecting a value of $\theta_{max}<\theta_{desired}$ may effectively result in an angle between the exterior surfaces 335A of panels 333A, 333B that is closer to $\theta_{desired}$ (after the connection of support members 136). In the case of the illustrated embodiment of FIGS. 6A and 6B, selecting a value of $\theta_{max}$<180° (prior to the connection of support members 136) may effectively create an angle between the exterior surfaces 335A of panels 333A, 333B that is closer to $\theta_{desired}$=180° (after the connection of support members 136).

The forces which cause deformation of panels 333A, 333B so that the interior angle between panels 333A, 333B increases from $\theta_{max}$ to $\theta_{desired}$ may additionally or alternatively come from the introduction of liquid concrete to the corresponding formwork. For example, where panels 333A, 333B and their respective connection 350 (FIG. 6B) are part of a formwork and liquid concrete (or other curable construction material) is introduced into an interior of the formwork, the weight of the liquid concrete applies pressure to panels 333A, 333B. More particularly, forces associated with this pressure will act generally perpendicularly to interior surfaces 335B of panels 333A, 333B as shown by arrows 14 (in the case of panel 333A) and 15 (in the case of panel 333B). One or both of the portions of panels 333A, 333B illustrated in FIGS. 6A and 6B may tend to deform under the forces caused this pressure in the direction of arrow 15. This deformation under the weight of liquid concrete may cause exterior surfaces 335A of panels 333A, 333B to become relatively more parallel with one another—i.e. so that the angle between the exterior surfaces 335A of panels 333A, 333B changes from $\theta_{max}$ (prior to the introduction of concrete) to a value closer to the desired ultimate angle $\theta_{desired}$ (after the introduction of concrete). Accordingly, selecting a value of $\theta_{max}<\theta_{desired}$ (prior to the introduction of concrete) may effectively result in an angle between the exterior surfaces 335A of panels 333A, 333B that is closer to $\theta_{desired}$ (after the introduction of concrete). In the case of the illustrated embodiment of FIGS. 6A and 6B, selecting a value of $\theta_{max}$<180° (prior to the introduction of concrete) may effectively create an angle between the exterior surfaces 335A of panels 333A, 333B that is closer to $\theta_{desired}$=180° (after the introduction of concrete).

Providing a value of $\theta_{max}<\theta_{desired}$ may also increase the sealing force between connector components 332, 334 of panels 333A, 333B. More particularly, forces caused by the connection of support members 136 to panels 333A, 333B and/or the pressure associated with the weight of liquid concrete may be directed generally perpendicularly to interior surface 335B of panel 333B. Forces oriented in this direction include transversely directed components which tend to pull the hooks 368 of connector component 332 toward, and into more forceful engagement with, the hooks 359 of connector component 334, thereby increasing the sealing force between connector components 332, 334 of panels 333A, 333B. Further forces oriented in this direction include outward components which create torques which tend to push abutment surfaces 357, 372 toward, and into more forceful engagement with one another.

In other respects, panels 333A, 333B, their connector components 332, 334 and their connections 380, 350 are substantially similar to panels 133A, 133B, connector components 132, 134 and connections 180, 150 described herein and any reference to panels 133A, 133B, connector components 132, 134 and connections 180, 150 should be understood to be applicable (where appropriate) to panels 333A, 333B, connector components 332, 334 and connections 380, 350.

Referring back to FIGS. 4E and 4F, the surface area of contact between abutment surfaces 157, 172 when connector components 132, 134 form connection 150 may comprise a relatively large contact surface area. Such a large contact surface area may advantageously improve the seal provided by connection 150 against fluids (e.g. liquids or, in some cases, gases). Such a large contact surface area may also improve the robustness of connection 150 to thermal expansion—e.g. because abutment surfaces 157, 172 may be permitted to move relative to one another (as may occur with thermal expansion or corresponding contraction), while still maintaining connection 150 with a sufficient seal against the passage of fluids. In some embodiments, a ratio of the contact surface area of abutment surfaces 157, 172 to the area associated with back wall 167 is greater than 25%. In some embodiments, this ratio is greater than 33%. It will be appreciated that the cross-section of panels 133A, 133B may be uniform along their longitudinal dimensions (e.g. into and out of the page in the illustrated views of FIGS. 4E and 4F). Consequently in such embodiments, these surface area ratios may be equivalently expressed as ratios of the width of the abutment surfaces 157, 172 (in a direction along their contact) to the depth of back wall 167 (or effectively to the depth of connector component 132).

In some embodiments, a sealing material (not shown) may be provided on some surfaces of connector components 132, 134. Such sealing material may be relatively soft (e.g. elastomeric) when compared to the material from which the remainder of panels 133 are formed. Such sealing materials may be provided using a co-extrusion process or coated onto connector components 132, 134 after fabrication of panels 133, for example. Such sealing materials may help to make connections 150 between edge adjacent panel 133A, 133B impermeable to liquids or gasses. Such sealing materials may be provided on any one or more contact surfaces of connector components 132, 134, including, by way of non-limiting example, such sealing materials may be provided on: one or both of fingers 156; one or both of restraining arms 164; one or both of phalanxes 161; elbow 169B; knee 153; and one or both of abutment surfaces 172, 157.

Figure 7A:
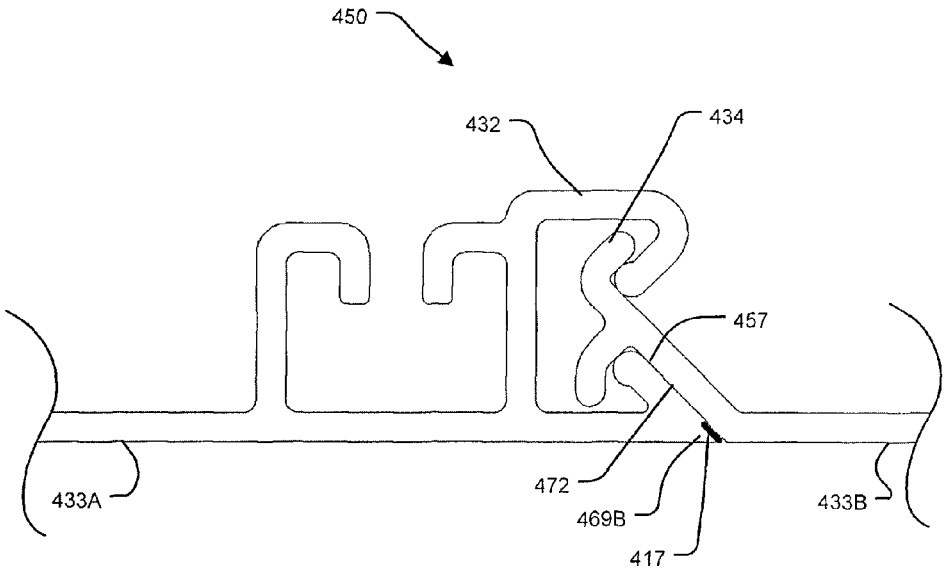
FIG. 7A-7D are enlarged partial plan views of connections between connector components of pairs of edge-adjacent panels according to other example embodiments.

FIG. 7A shows a connection 450 between connector components 432, 434 of edge-adjacent panels 433A, 433B according to an example embodiment where elastomeric sealing material 417 is provided on abutment surface 472 in a vicinity of knee 469B. Sealing material 417 may be co-extruded with panel 433A as discussed above. When abutment surfaces 457, 472 abut one another as described above to provide connection 450, sealing material 417 may be compressed to help maintain a seal between abutment surfaces 457, 472 that reduces the permeability of connection 450 to fluids. In other respects, panels 433A, 433B and connection 450 may be similar to panels 133A, 133B and connection 150 described herein.

Figure 7B:
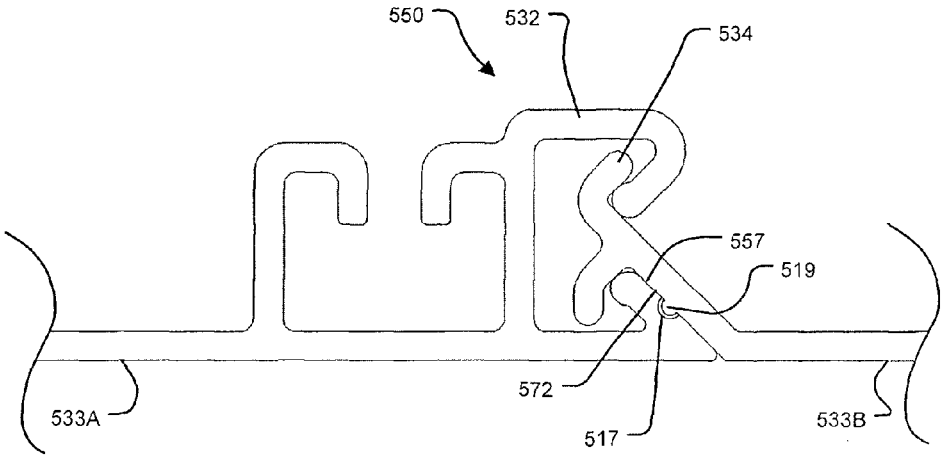

Bevelled abutment surfaces 152, 157 of connector components 132, 134 are generally planar surfaces. In some embodiments, the bevelled abutment surfaces of connector components may be provided with one or more complementary profile features (e.g. one or more complementary convexities and concavities) which may help to provide connections between the corresponding connector components and corresponding edge-adjacent panels. FIG. 7B shows a connection 550 between connector components 532, 534 of edge-adjacent panels 533A, 533B according to an example embodiment where abutment surface 572 comprises a concavity 517 and abutment surface 557 comprises a complementary convexity 519 which projects into concavity 517 when forming connection 550. The projection of convexity 519 into concavity 517 may help to register connector components 532, 534 and panels 533A, 533B relative to one another during the formation of connection 550 and may also help to prevent connection 550 from unzipping. Sealing material (not shown) may be co-extruded or otherwise applied to the surface(s) of one or both of concavity 517 and convexity 519 to help seal connection 550. In other respects, panels 533A, 533B and connection 550 may be similar to panels 133A, 133B and connection 150 described herein.

Figure 7C:
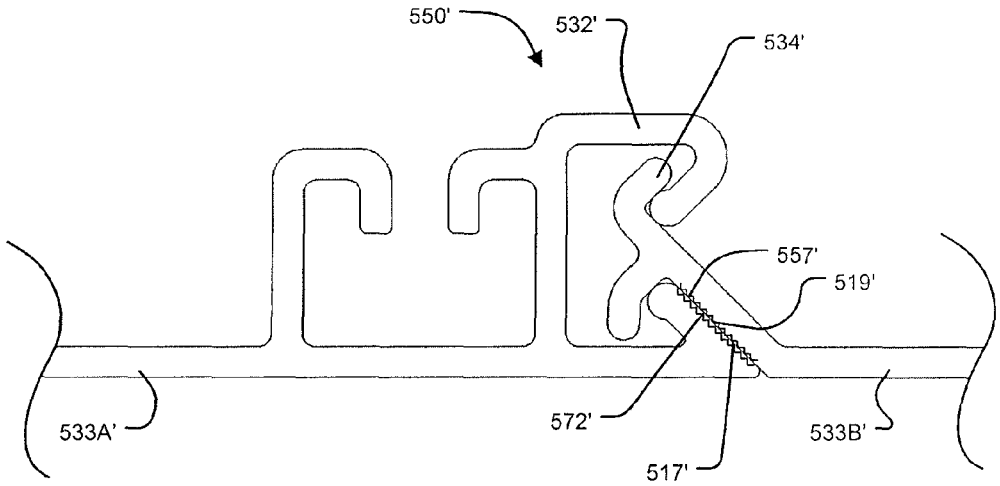

In some embodiments, multiple complementary profile features may be provided on the bevelled abutment surfaces of connector components. FIG. 7C shows a connection 550' between connector components 532', 534' of edge-adjacent panels 533A', 533B' according to an example embodiment where abutment surface 572' comprises a plurality of alternating concavities and convexities (e.g. in a toothed pattern 517') and abutment surface 557 comprises a complementary plurality of alternating concavities and convexities (e.g. in a complementary toothed patter 519'). When forming connection 550', toothed patterns 517', 519' engage one another and may help to register connector components 532', 534' and panels 533A', 533B' relative to one another and may also help to prevent connection 550' from unzipping. Sealing material (not shown) may be co-extruded or otherwise applied to the surface(s) of one or both of toothed patterns 517', 519' to help seal connection 550'. In other respects, panels 533A', 533B' and connection 550' may be similar to panels 133A, 133B and connection 150 described herein.

Figure 7D:
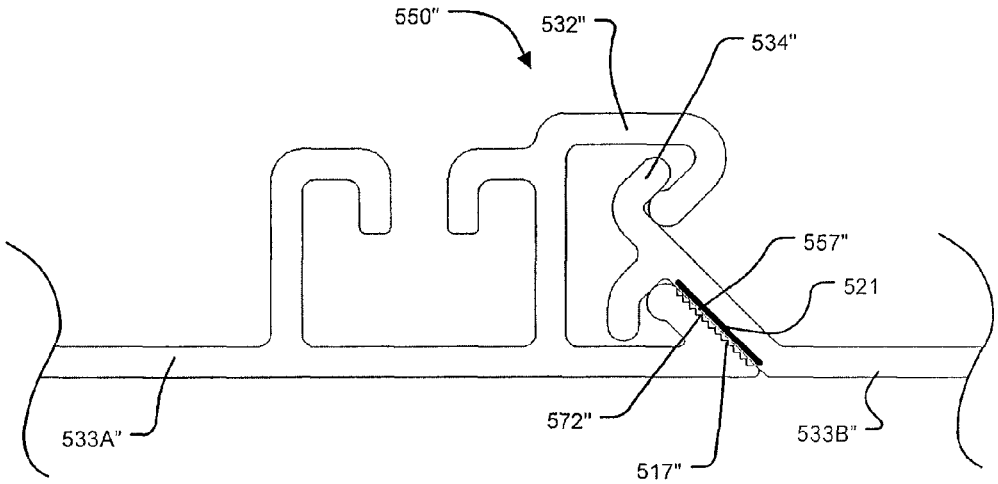

FIG. 7D shows a connection 550" between connector components 532", 534" of edge-adjacent panels 533A", 533B" according to an example embodiment where abutment surface 572" comprises a plurality of alternating concavities and convexities (e.g. in a toothed pattern 517") and abutment surface 557 is coated with a layer of sealing material 521 (e.g. elastomeric material). Sealing material 521 may be co-extruded with panel 533B" as discussed above. When forming connection 550", toothed pattern 517" may be squeezed into sealing material 521 may help to form a seal between abutment surfaces 557", 572" that reduces the permeability of connection 550" to fluids. In other respects, panels 533A", 533B" and connection 550" may be similar to panels 133A, 133B and connection 150 described herein.

Figure 8A:
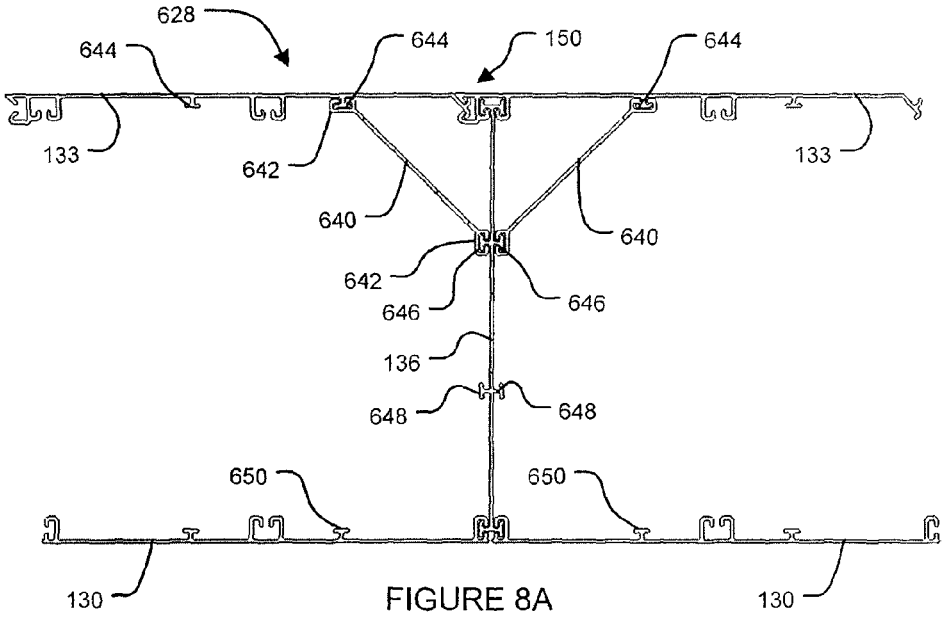
FIGS. 8A and 8B are partial cross-sectional views of portions of modular stay-in-place formworks according to other example embodiments.

FIG. 8A is a partial cross-sectional view of a portion of a modular stay-in-place formwork 628 according to an example embodiment. Formwork 628 is similar to formwork 128 discussed above and comprises panels 133, 130 and support members 136 which are substantially similar to panels 133, 130 and support members 136 of formwork 128. Formwork 628 differs from formwork 128 in that formwork 628 comprises tensioning braces 640 which extend between panels 133 and support members 136 to reinforce connections 150. Tensioning braces 640, which may be apertured to permit concrete flow therethrough, comprise connector components 642 at their respective ends to connection to complementary connector components 644, 646 on panels 133 and support members 136 respectively. In the illustrated embodiment, connector components 642 of tensioning braces 640 comprise female, C-shaped connector components which slidably receive male, T-shaped connector components 644, 646 of panels 133 and support members 136.

In other embodiments, connector components 642, 644, 646 may be different than those shown in the illustrated embodiment and may connect to one using techniques other than relative sliding, such as, by way of non-limiting example, deformable "snap-together" connections, pivotal connections, push on connections and/or the like. In some embodiments, tensioning braces 640 may be provided with male connector component and panels 133 and support members 136 may comprise female connector components. While not shown in the illustrated embodiment, tensioning braces 640 may additionally or alternatively be connected between connector components 648 of support members 136 and connector components 650 of panels 130.

In other respects, formwork 628 is substantially similar to formwork 128 described herein.

Figure 8B:
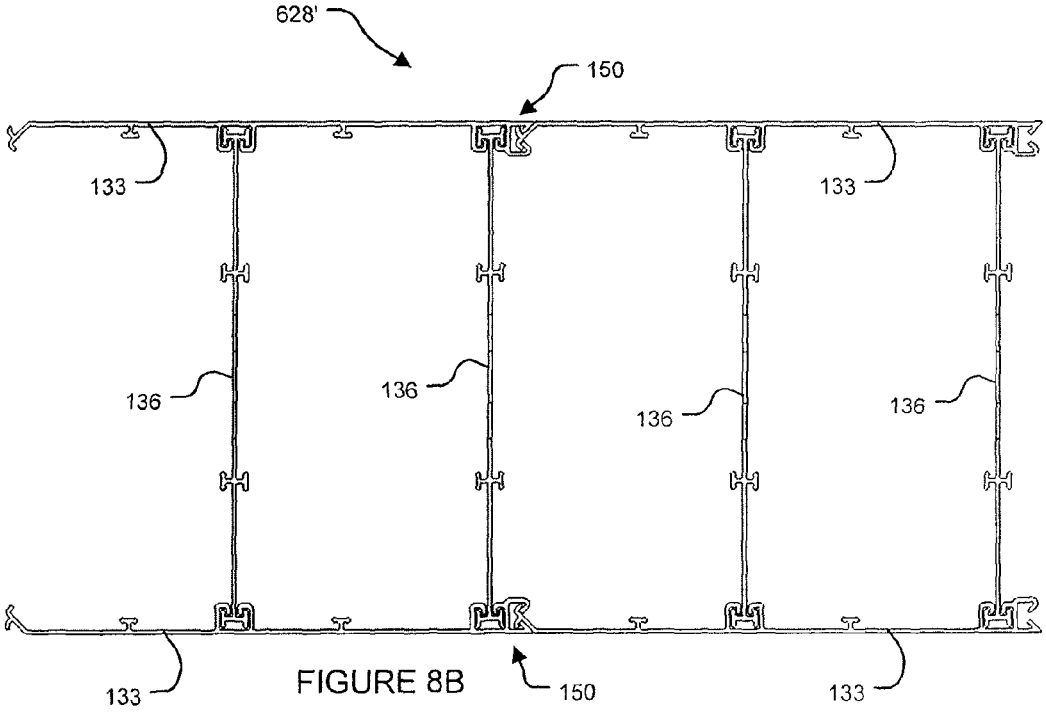

FIG. 8B is a partial cross-sectional view of a portion of a modular stay-in-place formwork 628' according to an example embodiment. Formwork 628' is similar to formwork 128 discussed above and comprises panels 133 and support members 136 which are substantially similar to panels 133 and support members 136 of formwork 128. Formwork 628' differs from formwork 128 in that formwork 628' comprises wall segments 627', 629' which are both provided by panels 133—i.e. formwork 628' comprises panels 133 on both sides of each support member 136. The connections 150 between, and operation of, panels 133 on ether side of support members 136 are substantially similar to that described above. In other respects, formwork 628' is substantially similar to formwork 128 described herein.

Figure 9A:
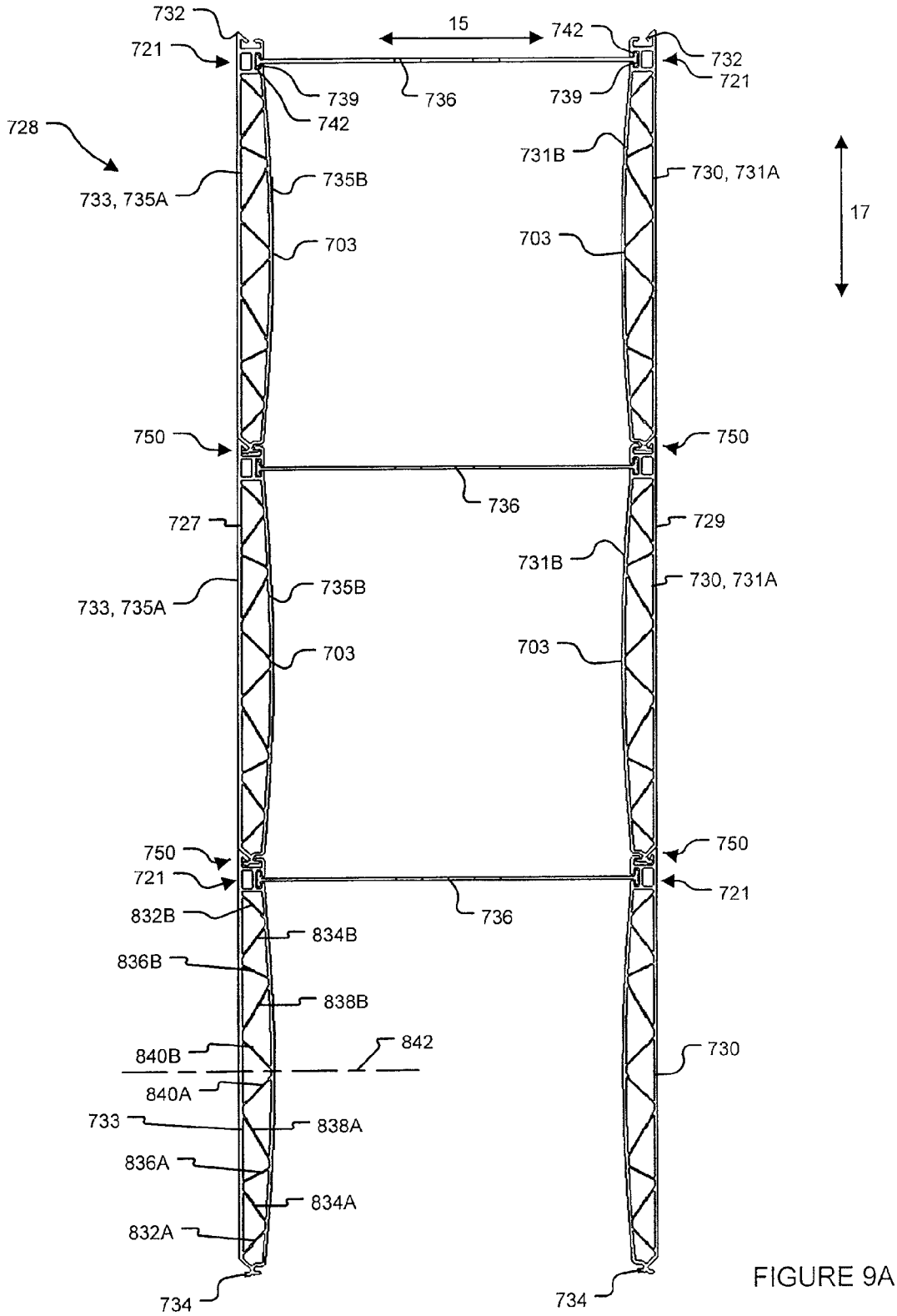
FIGS. 9A and 9B are partial cross-sectional views of portions of modular stay-in-place formworks according to other example embodiments

FIG. 9A is a partial cross-sectional view of a portion of a modular stay-in-place formwork 728 according to an example embodiment. Formwork 728 is similar to formwork 128 discussed above and similar reference numbers are used to refer to similar features, except that features of formwork 728 are referred to using reference numbers preceded by the numeral "7" whereas features of formwork 128 are referred to using reference numbers preceded by the numeral "1". Formwork 728 of the illustrated embodiment includes panels 730, 733 and support members 736 which are connected to one another to provide wall segments 727, 729 which, in the illustrated embodiment, extend in the vertical direction (into and out of the page in the FIG. 9A view) and in the transverse direction 17.

Panels 730, 733 of formwork 728 comprise female connector components 732 and male connector components 734 which are respectively substantially similar to female connector components 132 and male connector components 134 described herein. More particularly, female and male connector components 732, 734 comprise engagement portions and abutment portions (not specifically enumerated in FIG. 9A) which are substantially similar to engagement portions 182, 186 and abutment portions 184, 188 of connector components 132, 134 described herein and which function in a similar manner to provide connections 750 between edge-adjacent panels.

Panels 730, 733 differ from panels 130, 133 in that panels 730 respectively comprise outward facing (exterior) surfaces 731A, 735A and inward facing (interior) surfaces 731B, 735B that are spaced apart from one another and inward facing (interior) surfaces 731B, 735B of panels 730, 733 are shaped to provide inwardly protruding convexities 703 between the transverse edges of panels 730, 733. In the illustrated embodiment, convexities 703 are arcuately shaped, but this is not necessary and convexities 703 may be linearly convex.

Extending between exterior surfaces 731A, 735A and interior surfaces 731B, 735B of panels 730, 733 comprise a plurality of brace elements 832A, 832B, 834A, 834B, 836A, 836B, 838A, 838B, 840A, 840B. Brace elements 832A, 832B, 834A, 834B, 836A, 836B, 838A, 838B, 840A, 840B of the illustrated embodiment are oriented at non-orthogonal angles to both exterior surfaces 731A, 735A and interior surfaces 731B, 735B of panels 730, 733. In the illustrated embodiment, all of brace elements 832A, 832B, 834A, 834B, 836A, 836B, 838A, 838B, 840A, 840B in any one panel 730, 733 are non-parallel with one another. In the illustrated embodiment, brace elements 832A, 832B, 834A, 834B, 836A, 836B, 838A, 838B, 840A, 840B are oriented to be symmetrical about a notional transverse mid-plane 842—i.e. more particularly:

- the transversely outermost pair of brace elements 832A, 832B have orientations that are mirror images of one another relative to mid-plane 842 and are oriented with the same interior angle relative to exterior surfaces 731A, 735A;
- the second transversely outermost pair of brace elements 834A, 834B have orientations that are mirror images of one another relative to mid-plane 842 and are oriented with the same interior angle relative to exterior surfaces 731A, 735A;
- the third transversely outermost pair of brace elements 836A, 836B have orientations that are mirror images of one another relative to mid-plane 842 and are oriented with the same interior angle relative to exterior surfaces 731A, 735A;
- the fourth transversely outermost pair of brace elements 838A, 838B have orientations that are mirror images of one another relative to mid-plane 842 and are oriented with the same interior angle relative to exterior surfaces 731A, 735A;
- the transversely innermost pair of brace elements 840A, 840B have orientations that are mirror images of one another relative to mid-plane 842 and are oriented with the same interior angle relative to exterior surfaces 731A, 735A.

This shape of exterior and interior surfaces 731A, 731B and 735A, 735B and the orientations of brace elements 832A, 832B, 834A, 834B, 836A, 836B, 838A, 838B, 840A, 840B can reduce deformation (e.g. pillowing and bellying) in panels 730, 733. It will be appreciated that panels 730, 733 of the illustrated embodiment comprise five pairs of brace elements 832A, 832B, 834A, 834B, 836A, 836B, 838A, 838B, 840A, 840B that are symmetrical with respect to notional mid-plane 842, but that in other embodiments, panels may comprise other numbers of pairs of symmetrical brace elements.

Formwork 728 also differs from formwork 128 in that support members 736 comprise T-shaped male connector components 739 and panels 730, 733 comprise complementary female C-shaped connector components 742 which have different shapes (but similar functionality) to connector components 139, 142 of support members 136 and panels 130, 133.

Panels 730, 733 also differ from panels 130, 133 in that panels 730, 733 comprise connector component reinforcement structures 721 which reinforce connector components 732 and 742 and provide panels 730, 733 with additional stiffness and resistance to deformation in the region of connector components 732 and 742. In the illustrated embodiment, connector component reinforcement structures 721 are rectangular shaped comprising inward/outward members and transverse members (not specifically enumerated), although this is not necessary. In other embodiments, connector component reinforcement structures 721 could be provided with other shapes, while performing the same or similar function. For example, connector component reinforcement structures 721 could be made to have one or more non-orthogonal and non-parallel brace elements (e.g. similar to brace elements 832A, 832B, 834A, 834B, 836A, 836B, 838A, 838B, 840A, 840B described above) or connector component reinforcement structures 721 could be made to have one or more orthogonal and parallel brace elements.

In other respects, formwork 728 is substantially similar to formwork 128 described herein.

Figure 9B:
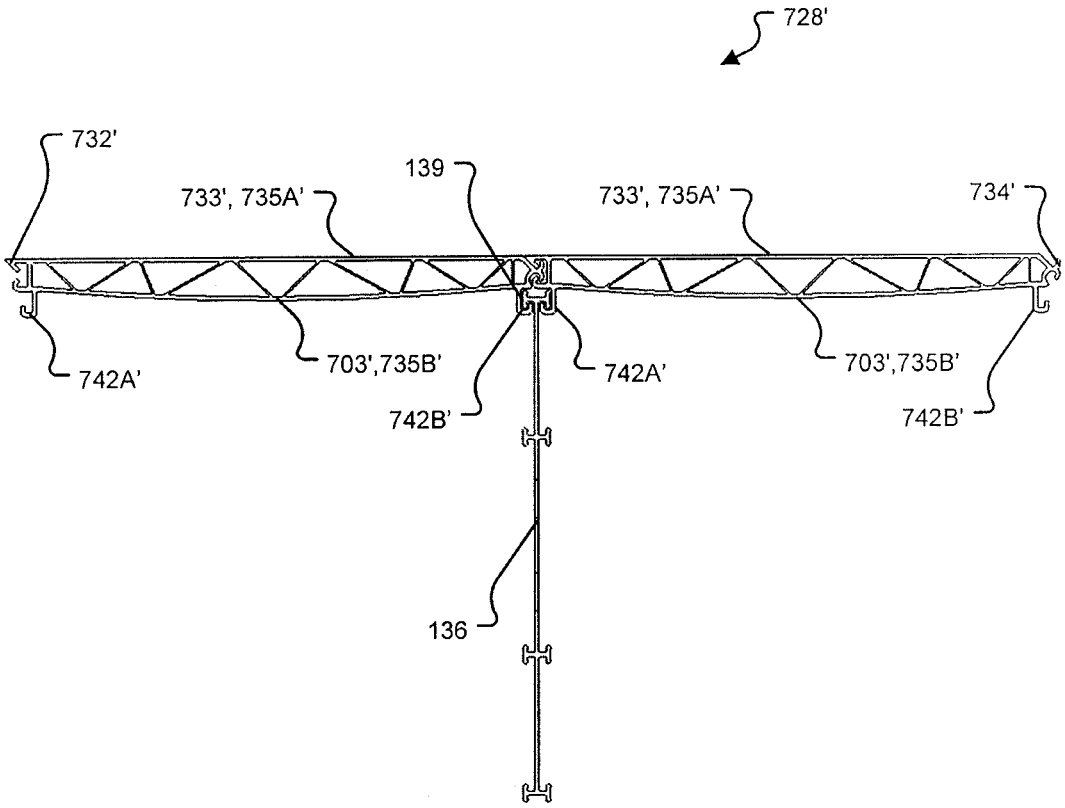

FIG. 9B is a partial cross-sectional view of a portion of a modular stay-in-place formwork 728' according to an example embodiment. Formwork 728' is similar in many respects to formwork 728 discussed above and similar reference numbers are used to refer to similar features, except that features of formwork 728' are referred to using reference numbers followed by the prime symbol ('). Panels 733' of formwork 728' comprise female connector components 732' and male connector components 734' which are respectively substantially similar to female connector components 732 and male connector components 734 of panels 733 described herein. Panels 733' are also similar to panels 733 in that they comprise outward facing (exterior) surfaces 735A' and inward facing (interior) surfaces 735B' that are spaced apart from one another and interior surfaces 735B' of panels 733' are shaped to provide inwardly protruding convexities 703' between the transverse edges of panels 733'. Panels 733' are also similar to panels 733 in that they comprise brace elements (not specifically enumerated in FIG. 9B) which extend between exterior surfaces 735A' and interior surfaces 735B' of panels 733' and which are substantially similar to brace elements 832A, 832B, 834A, 834B, 836A, 836B, 838A, 838B, 840A, 840B of panels 733 described herein.

Formwork 728' differs from formwork 728 in that formwork 728' comprises support members 136 (substantially identical to those of formwork 128) and edge-adjacent pairs of panels 733' are each provided with a J-shaped connector component 742A', 742B' at their transverse edges for engaging a portion of the connector component 139 of support member 136. More particularly, when panels 733' are connected in edge-adjacent relationship, a pair of J-shaped connector components 742A' 742B' (one from each edge-adjacent panel 733') together provide a "double-J" shaped female connector component for receiving the complementary connector component 139 of support member 136. This configuration of connector components may help to reinforce the connections between edge-adjacent panels 733'.

In other respects, formwork 728 is substantially similar to formwork 128 described herein.

Processes, methods, lists and the like are presented in a given order. Alternative examples may be performed in a different order, and some elements may be deleted, moved, added, subdivided, combined, and/or modified to provide additional, alternative or sub-combinations. Each of these elements may be implemented in a variety of different ways. Also, while elements are at times shown as being performed in series, they may instead be performed in parallel, or may be performed at different times. Some elements may be of a conditional nature, which is not shown for simplicity Where a component (e.g. a connector component, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

Those skilled in the art will appreciate that directional conventions such as "vertical", "transverse", "horizontal", "upward", "downward", "forward", "backward", "inward", "outward", "vertical", "transverse" and the like, used in this description and any accompanying claims (where present) depend on the specific orientation of the apparatus described. Accordingly, these directional terms are not strictly defined and should not be interpreted narrowly.

Unless the context clearly requires otherwise, throughout the description and any claims (where present), the words "comprise," "comprising," and the like are to be construed in an inclusive sense, that is, in the sense of "including, but not limited to." As used herein, the terms "connected," "coupled," or any variant thereof, means any connection or coupling, either direct or indirect, between two or more elements; the coupling or connection between the elements can be physical, logical, or a combination thereof. Additionally, the words "herein," "above," "below," and words of similar import, shall refer to this document as a whole and not to any particular portions. Where the context permits, words using the singular or plural number may also include the plural or singular number respectively. The word "or," in reference to a list of two or more items, covers all of the following interpretations of the word: any of the items in the list, all of the items in the list, and any combination of the items in the list.

While a number of exemplary aspects and embodiments have been discussed above, those of skill in the art will recognize certain modifications, permutations, additions and sub-combinations thereof. For example:

In the FIG. 3 embodiment, formwork 128 comprises a pair of wall segments 127, 129 which extend in the vertical direction 19 and the transverse direction 17. Formworks used for tilt-up walls and/or for lining structures need only comprise a single wall segment. In addition, structures fabricated using formworks according to various embodiments of the invention are not limited to walls. In such embodiments, groups of edge-adjacent panels 133 connected in edge-to-edge relationship at connections 150 may be more generally referred to as formwork segments instead of wall segments. In the illustrated embodiment, wall segments 127, 129 are spaced apart from one another in the inward-outward direction by an amount that is relatively constant, such that wall segments 127, 129 are generally parallel. This is not necessary. In some embodiments, wall segments 127, 129 need not be parallel to one another and different portions of formworks according to the invention may have different inward-outward dimensions.

In some embodiments, it may be desirable to provide walls which incorporate insulation. Insulation may be provided in the form of rigid foam insulation. Non-limiting examples of suitable materials for rigid foam insulation include: expanded poly-styrene, poly-urethane, poly-isocyanurate or any other suitable moisture resistant material. By way of non-limiting example, insulation layers may be provided in any of the forms described herein. Such insulation layers may extend in the longitudinal direction and in a transverse direction (i.e. between the interior and exterior surfaces of a formwork). Such insulation layers may be located centrally within the wall or at one side of the wall. Such insulation may be provided in segments whose transverse widths match those of the panels (e.g. panels 133) described herein and may fit between corresponding pairs of support members (e.g. support members 136) described herein. In some embodiments, sound-proofing materials may be layered into the forms described herein in a manner similar to that of insulation.

As is well known in the art, reinforcement bars (sometimes referred to as rebar) may be used to strengthen concrete structures. Rebar may be assembled into the formworks described above. By way of non-limiting example, rebar may be assembled into formwork 128 described above by extending rebar transversely (e.g. horizontally) through apertures 141, 143 in support members 136 (FIG. 3D) and vertically oriented rebar may be tied or otherwise fastened to the horizontal rebar.

In the embodiments described herein, the structural material used to fabricate the wall segments is concrete. This is not necessary. In some applications, it may be desirable to use other structural materials which may be initially be introduced placed into formworks and may subsequently solidify or cure.

In the embodiments described herein, the outward facing surfaces (e.g. surfaces 135A) of some panels (e.g. panels 133) are substantially flat. In other embodiments, panels may be provided with inward/outward corrugations. Such corrugations may extend longitudinally and/or transversely. Such corrugations may help to further prevent or minimize pillowing of panels under the weight of liquid concrete.

In the embodiments described herein, various features of the panels described herein (e.g. connector components 132, 134 of panels 133) are substantially co-extensive with the panels in longitudinal dimension 19. This is not necessary. In some embodiments, such features may be located at various locations on the longitudinal dimension 19 of the panels and may be absent at other locations on the longitudinal dimension 19 of the panels.

In some embodiments, the formworks described herein may be used to fabricate walls, ceilings or floors of buildings or similar structures. In general, the formworks described above are not limited to building structures and may be used to construct any suitable structures formed from concrete or similar materials. Non-limiting examples of such structures include transportation structures (e.g. bridge supports and freeway supports), beams, foundations, sidewalks, pipes, tanks, beams and the like.

Structures (e.g. walls) fabricated according to the invention may have curvature. Where it is desired to provide a structure with a certain radius of curvature, panels on the inside of the curve may be provided with a shorter length than corresponding panels on the outside of the curve. This length difference will accommodate for the differences in the radii of curvature between the inside and outside of the curve. It will be appreciated that this length difference will depend on the thickness of the structure.

Portions of connector components may be coated with or may otherwise incorporate antibacterial, antiviral and/or antifungal agents. By way of non-limiting example, Microban™ manufactured by Microban International, Ltd. of New York, N.Y. may be coated onto and/or incorporated into connector components during manufacture thereof. Portions of connector component may also be coated with elastomeric sealing materials. Such sealing materials may be co-extruded with their corresponding components.

Many embodiments and variations are described above. Those skilled in the art will appreciate that various aspects of any of the above-described embodiments may be incorporated into any of the other ones of the above-described embodiments by suitable modification.

What is claimed is:

1. A formwork assembly comprising:

a plurality of elongated panels connectable to one another in edge-adjacent relationship, each panel comprising a longitudinally extending outer surface that also extends transversely between a pair of opposing transverse edges;

the plurality of panels comprising first and second edge-adjacent panels connectable to one another at corresponding ones of their transverse edge by a connection between a male connector component of the first panel and a female connector component of the second panel;

the female connector component comprising a female engagement portion which defines a principal receptacle and the male connector component comprising a male engagement portion which is received in the principal receptacle to form the connection; and the male connector component comprising a first abutment portion and the female connector component comprising a second abutment portion which abuts against the first abutment portion to form the connection;

wherein the first and second abutment portions are located outside of the principal receptacle and the first and second abutment portions comprise corresponding first and second abutment surfaces and wherein: the first abutment surface is bevelled at a first interior bevel angle $\alpha$ with respect to the outer surface of the first panel; the second abutment surface is bevelled at a second interior bevel angle $\beta$ with respect to the outer surface of the second panel; a sum $\theta_{max}$ of the first and second interior bevel angles is less than a desired ultimate angle $\theta_{desired}$ between the outer surfaces of the first and second panels which is achieved when the connection is formed by deforming at least one of the first and second edge-adjacent panels.

2. A formwork assembly according to claim 1 wherein the first and second abutment surfaces are generally flat.

3. A formwork assembly according to claim 1 wherein the first and second abutment surfaces comprise one or more complementary convexities and concavities and wherein the one or more convexities project into the one or more concavities to form the connection.

4. A formwork assembly according to claim 1 wherein at least one of the first and second abutment surfaces comprises an elastomeric sealing material.

5. A formwork assembly according to claim 4 wherein the elastomeric sealing material is provided in the form of a coating on the at least one of the first and second abutment surfaces.

6. A formwork assembly according to claim 4 wherein the elastomeric sealing material is co-extruded onto the at least one of the first and second abutment surfaces during fabrication of the first and second edge-adjacent panels.

7. A formwork assembly according to claim 1 wherein the male and female connector components are shaped to be connectable to one another in a loose-fit connection wherein the male engagement portion is received in the principal receptacle and the first and second abutment portions are spaced apart from one another.

8. A formwork assembly according to claim 7 wherein the male and female engagement portions are shaped to be connectable to one another in the loose-fit connection without substantial deformation of the male and female engagement portions.

9. A formwork assembly according to claim 7 wherein the male and female engagement portions are shaped, such that when they are connected in the loose-fit connection, the first panel can move relative to the second panel in a direction of the elongated dimension of the panels without substantial friction between the male and female engagement portions.

10. A formwork assembly according to claim 1 wherein the sum of the first and second interior bevel angles is less than 180°.

11. A formwork assembly according to claim 1 wherein the sum of the first and second interior bevel angles is in a range of 160° to 179°.

12. A formwork assembly according to claim 1 and wherein the sum of the first and second interior bevel angles is in a range of 181° to 200°.

13. A formwork assembly according to claim 1 wherein a ratio of the sum $\theta_{max}$ of the first and second interior bevel angles to the desired ultimate angle $\theta_{desired}$ which is achieved when the connection is formed is in a range of 95-99.5%.

14. A formwork assembly according to claim 1 wherein the connection is formed by deforming one or both of the male and female connector components.

15. A formwork assembly according to claim 1 wherein the desired ultimate angle $\theta_{desired}$ which is achieved when the connection is formed is about 180°.

16. A formwork assembly according to claim 1 wherein the desired ultimate angle $\theta_{desired}$ which is achieved when the connection is formed is in a range of 160° to 179°.

17. A formwork assembly according to claim 1 wherein the desired ultimate angle $\theta_{desired}$ which is achieved when the connection is formed is in a range of 181° to 200°.

18. A formwork assembly according to claim 1 wherein a ratio of a width of the first and second abutment surfaces to a maximum depth of the male and female connector components is greater than 25%.

19. A formwork assembly according to claim 18 wherein a ratio of a width of the first and second abutment surfaces to a maximum depth of the male and female connector components is greater than 33%.

20. A formwork assembly according to claim 1 wherein the female engagement portion comprises one or more hooks which define one or more corresponding hook concavities and wherein the one or more corresponding hook concavities receive one or more corresponding projections of the male engagement portion.

21. A formwork assembly according to claim 1 wherein the male engagement portion comprises one or more hooks which define one or more corresponding hook concavities and wherein the one of more corresponding hook concavities receive one of more corresponding projections of the female engagement portions.

22. A method for connecting first and second panels of a formwork assembly in an edge adjacent relationship, the method comprising:

providing a first panel and a second panel, each of the first and second panels comprising: a first longitudinally extending transverse edge comprising a male engagement portion and a first abutment surface; and an opposing longitudinally extending transverse edge comprising a female engagement portion which defines a principal receptacle and a second abutment surface, the first and opposing transverse edges separated by a longitudinally and transversely extending outer surface;

inserting the male engagement portion of the first panel into the principal receptacle of the female engagement portion of the second panel and abutting the first abutment surface of the first panel against the second abutment surface of the second panel;

wherein abutting the first abutment surface against the second abutment surface occurs outside of the principal receptacle;

wherein: the first abutment surface is bevelled at a first interior bevel angle $\alpha$ with respect to the outer surface of the first panel; the second abutment surface is bevelled at a second interior bevel angle $\beta$ with respect to the outer surface of the second panel; a sum $\theta_{max}$ of the first and second interior bevel angles is less than a desired ultimate angle $\theta_{desired}$ between the outer surfaces of the first and second panels; and wherein abutting the first abutment surface against the second abutment surface comprises achieving the desired ultimate angle $\theta_{desired}$ between the outer surfaces of the first and second panels by deforming at least one of the first and second edge-adjacent panels.

23. A method according to claim 22 wherein the first and second abutment surfaces comprise one or more complementary concavities and convexities and wherein the method comprises projecting the one or more convexities into the one or more concavities to form the connection.

24. A formwork assembly comprising:

a plurality of elongated panels connectable to one another in edge-adjacent relationship, each panel comprising a longitudinally extending outer surface that also extends transversely between a pair of opposing transverse edges;

the plurality of panels comprising first and second edge-adjacent panels connectable to one another at corresponding ones of their transverse edge by a connection between a male connector component of the first panel and a female connector component of the second panel;

the female connector component comprising a female engagement portion which defines a principal receptacle and the male connector component comprising a male engagement portion which is received in the principal receptacle to form the connection; and the male connector component comprising a first, generally planar abutment surface that is bevelled with respect to an outer surface of first panel and the female connector component comprising a second, generally planar abutment surface that is bevelled with respect to an outer surface of the second panel;

wherein the first and second abutment surfaces abut against each other to form the connection; and wherein the first and second abutment surfaces comprise one or more complementary convexities and concavities and wherein the one or more convexities project into the one or more concavities to form the connection.

25. A formwork assembly according to claim 24 wherein: the first abutment surface is bevelled at a first interior bevel angle $\alpha$ with respect to the outer surface of the first panel; the second abutment surface is bevelled at a second interior bevel angle $\beta$ with respect to the outer surface of the second panel; a sum $\theta_{max}$ of the first and second interior bevel angles is less than a desired ultimate angle $\theta_{desired}$ between the outer surfaces of the first and second panels which is achieved when the connection is formed by deforming at least one of the first and second edge-adjacent panels.

26. A formwork assembly according to claim 25 wherein the desired ultimate angle $\theta_{desired}$ which is achieved when the connection is formed is about 180°.

* * * * *